US008651978B2

(12) United States Patent
Sajima et al.

(10) Patent No.: US 8,651,978 B2
(45) Date of Patent: Feb. 18, 2014

(54) GOLF BALL

(75) Inventors: Takahiro Sajima, Kobe (JP); Hirotaka Nakamura, Kobe (JP); Hyoungchol Kim, Kobe (JP)

(73) Assignee: SRI Sports Limited, Kobe (KR)

( * ) Notice: Subject to any disclaimer, the term of this patent is extended or adjusted under 35 U.S.C. 154(b) by 571 days.

(21) Appl. No.: 12/827,792

(22) Filed: Jun. 30, 2010

(65) Prior Publication Data

US 2011/0034274 A1 Feb. 10, 2011

(30) Foreign Application Priority Data

Aug. 5, 2009 (JP) ..... 2009-182032

(51) Int. Cl.
*A63B 37/12* (2006.01)

(52) U.S. Cl.
USPC ..... 473/378

(58) Field of Classification Search
USPC ..... 473/378–385
See application file for complete search history.

(56) References Cited

U.S. PATENT DOCUMENTS

| | | | | |
|---|---|---|---|---|
| 7,056,234 | B2 * | 6/2006 | Kasashima | 473/384 |
| 7,278,930 | B2 * | 10/2007 | Yokota et al. | 473/378 |
| 2004/0157682 | A1 | 8/2004 | Morgan et al. | |
| 2007/0149321 | A1 | 6/2007 | Sajima | |

FOREIGN PATENT DOCUMENTS

JP 04-109968 A 4/1992

* cited by examiner

*Primary Examiner* — Raeann Gorden
(74) *Attorney, Agent, or Firm* — Birch, Stewart, Kolasch & Birch, LLP

(57) ABSTRACT

The golf ball 2 has a northern hemisphere N and a southern hemisphere S. The northern hemisphere N is adjacent to the southern hemisphere S across an equatorial line Eq. Each of the northern hemisphere N and the southern hemisphere S has a pole vicinity region 14 and an equator vicinity region 16. Each of the pole vicinity region 14 and the equator vicinity region 16 has a large number of dimples. The dimple pattern of the pole vicinity region 14 includes three units that are rotationally symmetrical to each other about a pole Po. The dimple pattern of the equator vicinity region 16 includes six units that are rotationally symmetrical to each other about the pole Po. The sum (Ps+Pp) of a peak value Ps and a peak value Pp of the golf ball 2 is equal to or greater than 600 mm.

13 Claims, 28 Drawing Sheets

A
A
A
A
B
A
A
A
A
A
B
B
B
B
B
B
B
B
A
A
A
A
A

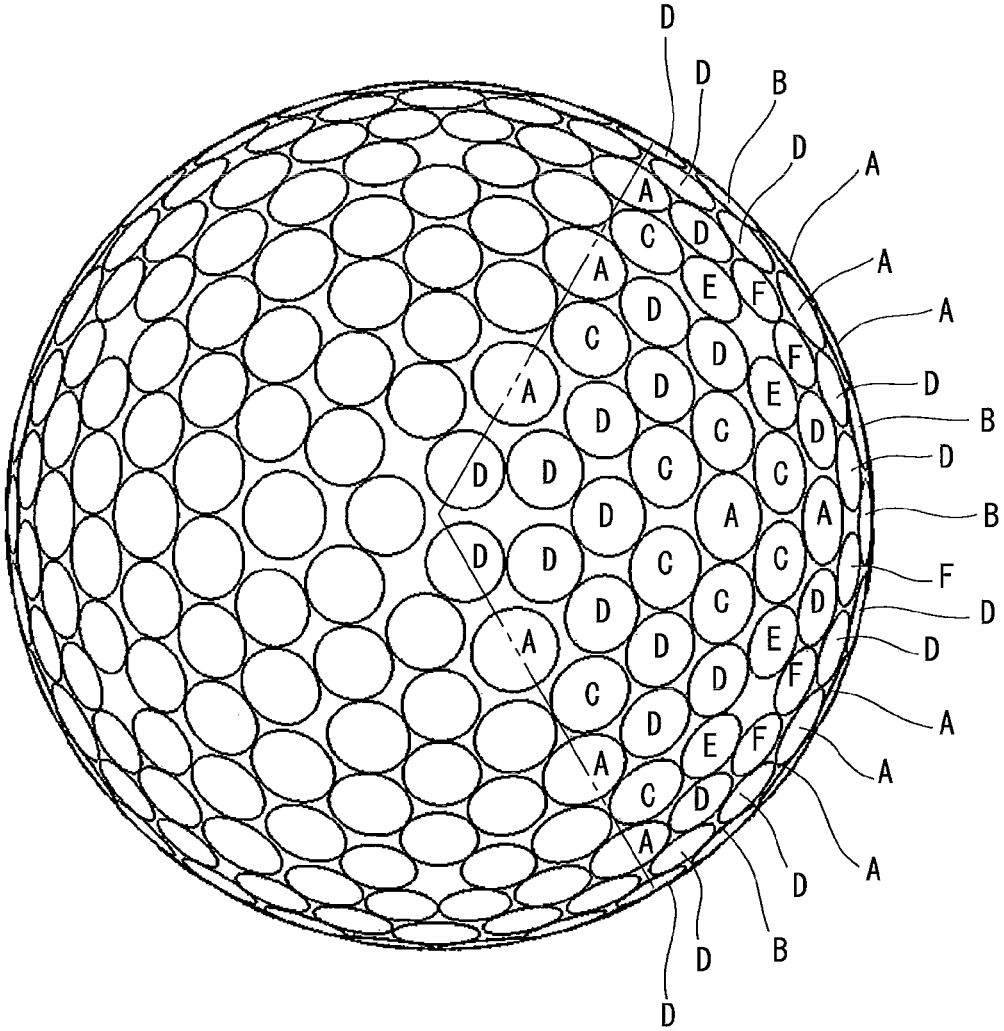
D
D
B
D
A
A
A
A
D
B
D
B
F
D
D
D
A
A
D
D
D

GOLF BALL

This application claims priority on Patent Application No. 2009-182032 filed in JAPAN on Aug. 5, 2009. The entire contents of this Japanese Patent Application are hereby incorporated by reference.

BACKGROUND OF THE INVENTION

1. Field of the Invention

The present invention relates to golf balls. Specifically, the present invention relates to improvement of dimples of golf balls.

2. Description of the Related Art

Golf balls have a large number of dimples on the surface thereof. The dimples disturb the air flow around the golf ball during flight to cause turbulent flow separation. By causing the turbulent flow separation, separation points of the air from the golf ball shift backwards leading to a reduction of drag. The turbulent flow separation promotes the displacement between the separation point on the upper side and the separation point on the lower side of the golf ball, which results from the backspin, thereby enhancing the lift force that acts upon the golf ball. The reduction of drag and the enhancement of lift force are referred to as a "dimple effect". Excellent dimples efficiently disturb the air flow. The excellent dimples produce a long flight distance.

There have been various proposals for a dimple pattern. JPH4-109968 discloses a golf ball whose hemisphere is divided into six units. These units have dimple patterns that are equivalent to each other. US2004/157682 (JP2004-243124) discloses a dimple pattern in which an octahedron is used for dividing a region near a pole and an icosahedron is used for dividing a region near an equatorial line.

US2007/149321 (JP2007-175267) discloses a golf ball having a pole vicinity region, an equator vicinity region, and a coordination region. The number of units Up of the pole vicinity region is different from the number of units Ue of the equator vicinity region. This difference disturbs air flow. The difference between the characteristic of the pole vicinity region and the characteristic of the equator vicinity region is alleviated by the coordination region.

The greatest interest to golf players concerning golf balls is flight distance. In light of flight performance, there is room for improvement in the dimple pattern. An objective of the present invention is to provide a golf ball having excellent flight performance.

SUMMARY OF THE INVENTION

A golf ball according to the present invention has a large number of dimples on a surface thereof. A ratio of a sum of areas of these dimples to a surface area of a phantom sphere of the golf ball is equal to or greater than 70%. A sum (Ps+Pp) of a peak value Ps and a peak value Pp is equal to or greater than 600 mm. According to the finding by the inventor of the present invention, in the golf ball with the sum (Ps+Pp) being 600 or greater, a long flight distance is obtained. The peak value Ps and the peak value Pp are obtained by the steps of:

(1) assuming a line connecting both poles of the golf ball as a first rotation axis;

(2) assuming a great circle which exists on a surface of the phantom sphere of the golf ball and is orthogonal to the first rotation axis;

(3) assuming two small circles which exist on the surface of the phantom sphere of the golf ball, which are orthogonal to the first rotation axis, and of which an absolute value of a central angle with the great circle is 30°;

(4) defining a region, of the surface of the golf ball, which is obtained by dividing the surface of the golf ball at the two small circles and which is sandwiched between the two small circles;

(5) determining 30240 points, on the region, which are arranged at intervals of a central angle of 3° in a direction of the first rotation axis and at intervals of a central angle of 0.25° in a direction of rotation about the first rotation axis;

(6) calculating a length L1 of a perpendicular line which extends from each point to the first rotation axis;

(7) calculating a total length L2 by summing 21 lengths L1 which are calculated on the basis of 21 perpendicular lines arranged in the direction of the first rotation axis;

(8) obtaining a first transformed data constellation by performing Fourier transformation on a first data constellation of 1440 total lengths L2 which are calculated along the direction of rotation about the first rotation axis;

(9) determining the peak value Ps and an order Fs of a maximum peak of the first transformed data constellation;

(10) assuming a second rotation axis orthogonal to the first rotation axis assumed at the step (1);

(11) assuming a great circle which exists on the surface of the phantom sphere of the golf ball and is orthogonal to the second rotation axis;

(12) assuming two small circles which exist on the surface of the phantom sphere of the golf ball, which are orthogonal to the second rotation axis, and of which an absolute value of a central angle with the great circle is 30°;

(13) defining a region, of the surface of the golf ball, which is obtained by dividing the surface of the golf ball at the two small circles and which is sandwiched between the two small circles;

(14) determining 30240 points, on the region, which are arranged at intervals of a central angle of 3° in a direction of the second rotation axis and at intervals of a central angle of 0.25° in a direction of rotation about the second rotation axis;

(15) calculating a length L1 of a perpendicular line which extends from each point to the second rotation axis;

(16) calculating a total length L2 by summing 21 lengths L1 which are calculated on the basis of 21 perpendicular lines arranged in the direction of the second rotation axis;

(17) obtaining a second transformed data constellation by performing Fourier transformation on a second data constellation of 1440 total lengths L2 which are calculated along the direction of rotation about the second rotation axis; and

(18) determining the peak value Pp and an order Fp of a maximum peak of the second transformed data constellation.

Preferably, the sum (Ps+Pp) is equal to or less than 1000 mm. Preferably, an absolute value of a difference (Ps−Pp) between the peak value Ps and the peak value Pp is equal to or less than 250 mm.

Preferably, each of the order Fs and the order Fp, which are obtained by the steps (1) to (18), is equal to or greater than 20 and equal to or less than 40. An absolute value of a difference (Fs−Fp) between the order Fs and the order Fp is equal to or less than 10.

Each of a northern hemisphere and a southern hemisphere of the surface of the golf ball has a pole vicinity region and an equator vicinity region. A dimple pattern of the pole vicinity region includes a plurality of units that are rotationally symmetrical to each other about the pole. A dimple pattern of the equator vicinity region includes a plurality of units that are rotationally symmetrical to each other about the pole. Preferably, the number Np of the units of the pole vicinity region is different from the number Ne of the units of the equator vicinity region. Preferably, the number Np is equal to or greater than 3 and equal to or less than 6. Preferably, the number Ne is equal to or greater than 3 and equal to or less than 6. Preferably, one of the number Np and the number Ne is a multiple of the other of the number Np and the number Ne. Preferably, a latitude of a boundary line located between the pole vicinity region and the equator vicinity region is equal to or greater than 20° and equal to or less than 40°. Preferably, a ratio of the number of the dimples that exist in the pole vicinity region to the number of the dimples that exist in the hemisphere is equal to or greater than 20% and equal to or less than 70%. Preferably, a ratio of the number of the dimples that exist in the equator vicinity region to the number of the dimples that exist in the hemisphere is equal to or greater than 20% and equal to or less than 70%. Preferably, each dimple has a depth of 0.05 mm or greater and 0.60 mm or less, an average depth of the dimples in the equator vicinity region is greater than an average depth of the dimples in the pole vicinity region, and a difference between the average depth of the dimples in the equator vicinity region and the average depth of the dimples in the pole vicinity region is equal to or greater than 0.004 mm and equal to or less than 0.020 mm.

Preferably, a standard deviation of diameters of all the dimples is equal to or less than 0.30.

BRIEF DESCRIPTION OF THE DRAWINGS

FIG. 28 is a plan view of the golf ball in FIG. 27.

DESCRIPTION OF THE PREFERRED EMBODIMENTS

The following will describe in detail the present invention based on preferred embodiments with reference to the accompanying drawings.

Figure 1:
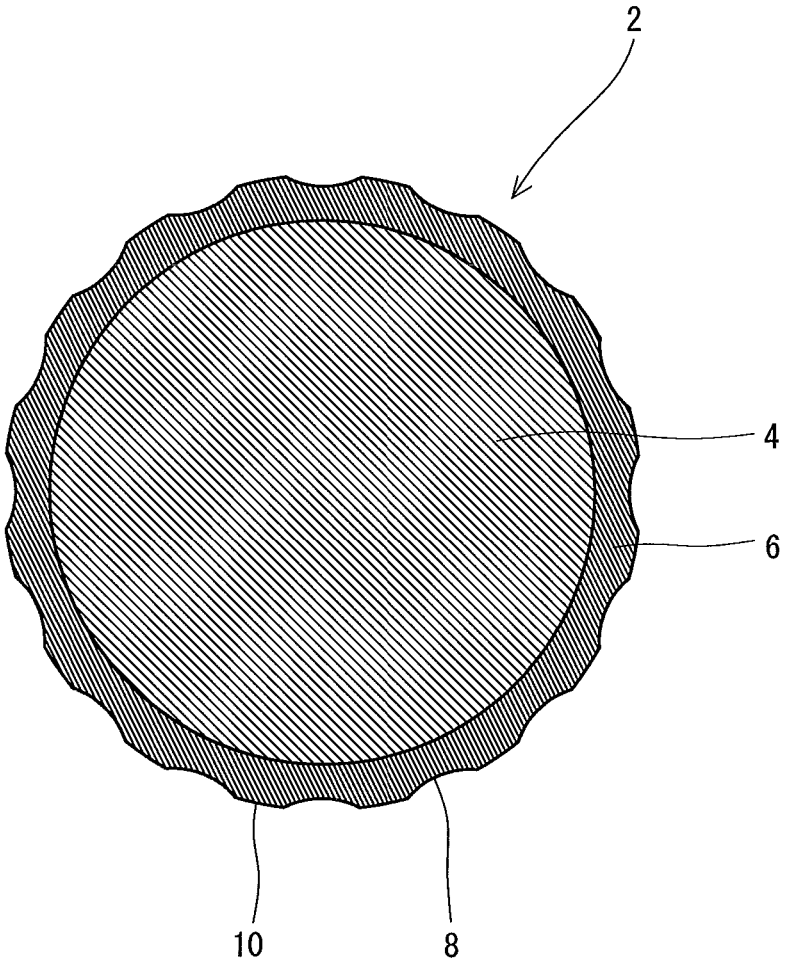
FIG. 1 is a schematic cross-sectional view of a golf ball according to an embodiment of the present invention.

A golf ball 2 shown in FIG. 1 includes a spherical core 4 and a cover 6. On the surface of the cover 6, a large number of dimples 8 are formed. Of the surface of the golf ball 2, a part other than the dimples 8 is a land 10. The golf ball 2 includes a paint layer and a mark layer on the external side of the cover 6 although these layers are not shown in the drawing. A mid layer may be provided between the core 4 and the cover 6.

The golf ball 2 has a diameter of 40 mm or greater and 45 mm or less. From the standpoint of conformity to the rules established by the United States Golf Association (USGA), the diameter is more preferably equal to or greater than 42.67 mm. In light of suppression of air resistance, the diameter is more preferably equal to or less than 44 mm and particularly preferably equal to or less than 42.80 mm. The golf ball 2 has a weight of 40 g or greater and 50 g or less. In light of attainment of great inertia, the weight is more preferably equal to or greater than 44 g and particularly preferably equal to or greater than 45.00 g. From the standpoint of conformity to the rules established by the USGA, the weight is more preferably equal to or less than 45.93 g.

The core 4 is formed by crosslinking a rubber composition. Examples of base rubbers in the rubber composition include polybutadienes, polyisoprenes, styrene-butadiene copolymers, ethylene-propylene-diene copolymers, and natural rubbers. Two or more types of these rubbers may be used in combination. In light of resilience performance, polybutadienes are preferred, and in particular, high-cis polybutadienes are preferred.

In order to crosslink the core 4, a co-crosslinking agent is suitably used. Examples of preferable co-crosslinking agents in light of resilience performance include zinc acrylate, magnesium acrylate, zinc methacrylate and magnesium methacrylate. Preferably, the rubber composition includes an organic peroxide together with a co-crosslinking agent. Examples of suitable organic peroxides include dicumyl peroxide, 1,1-bis(t-butylperoxy)-3,3,5-trimethylcyclohexane, 2,5-dimethyl-2,5-di(t-butylperoxy)hexane and di-t-butyl peroxide.

According to need, various additives such as a filler, sulfur, a vulcanization accelerator, a sulfur compound, an anti-aging agent, a coloring agent, a plasticizer, a dispersant, and the like are included in the rubber composition for the core 4 in an adequate amount. Crosslinked rubber powder or synthetic resin powder may be also included in the rubber composition.

The core 4 has a diameter of 30.0 mm or greater and particularly 38.0 mm or greater. The diameter of the core 4 is equal to or less than 42.0 mm and particularly equal to or less than 41.5 mm. The core 4 may be formed with two or more layers. The core may have a rib on the surface thereof. The core 4 may be hollow.

A suitable polymer for the cover 6 is an ionomer resin. Examples of preferable ionomer resins include binary copolymers formed with an α-olefin and an α,β-unsaturated carboxylic acid having 3 to 8 carbon atoms. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. For the binary copolymer and the ternary copolymer, preferable α-olefins are ethylene and propylene, while preferable α,β-unsaturated carboxylic acids are acrylic acid and methacrylic acid. In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion and neodymium ion.

Another polymer may be used for the cover 6 instead of an ionomer resin. Examples of the other polymer include polyurethanes, polystyrenes, polyamides, polyesters and polyolefins. In light of spin performance and scuff resistance, polyurethanes are preferred. Two or more types of these polymers may be used in combination.

According to need, a coloring agent such as titanium dioxide, a filler such as barium sulfate, a dispersant, an antioxidant, an ultraviolet absorber, a light stabilizer, a fluorescent material, a fluorescent brightener and the like are included in the cover 6 at an adequate amount. For the purpose of adjusting specific gravity, powder of a metal with a high specific gravity such as tungsten, molybdenum and the like may be included in the cover 6.

The cover 6 has a thickness of 0.2 mm or greater and particularly 0.3 mm or greater. The thickness of the cover 6 is equal to or less than 2.5 mm and particularly equal to or less than 2.2 mm. The cover 6 has a specific gravity of 0.90 or greater and particularly 0.95 or greater. The specific gravity of the cover 6 is equal to or less than 1.10 and particularly equal to or less than 1.05. The cover 6 may be formed with two or more layers.

Figure 2:
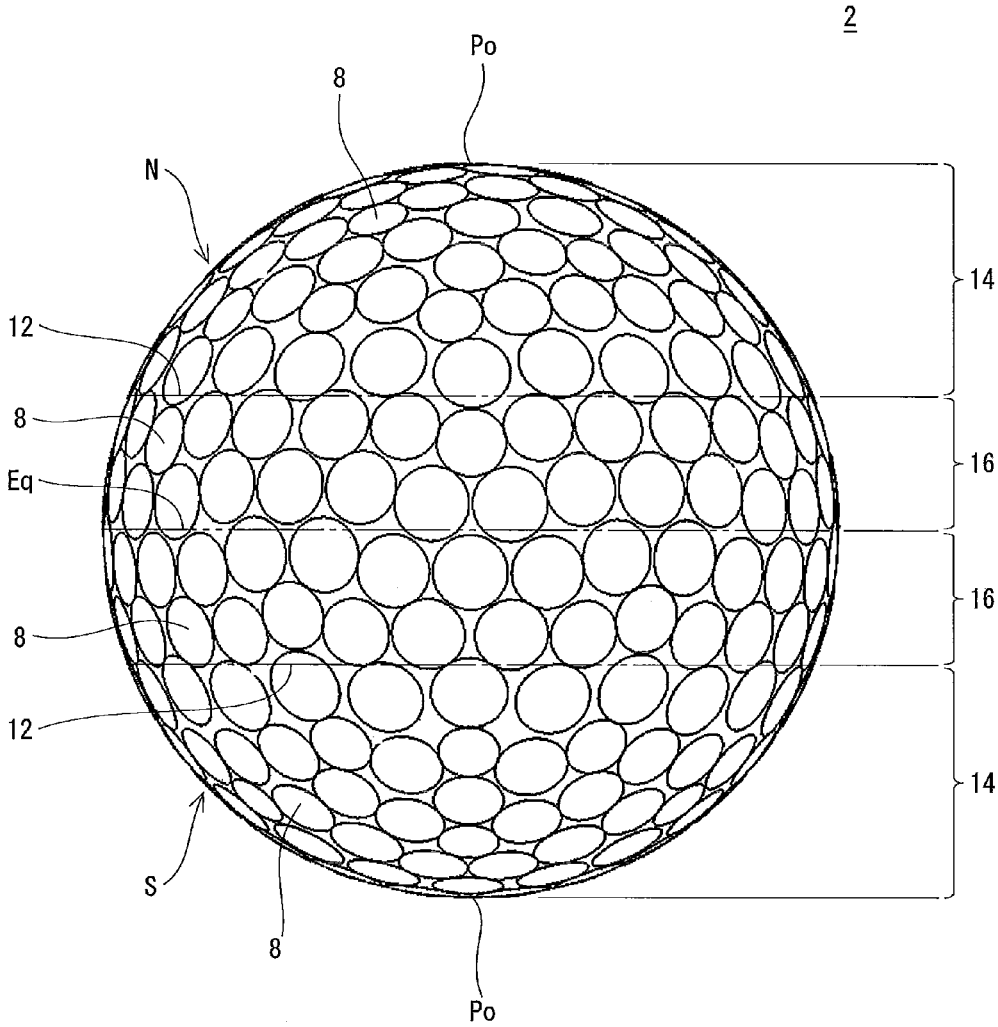
FIG. 2 is an enlarged front view of the golf ball in FIG. 1.

FIG. 2 is an enlarged front view of the golf ball 2 in FIG. 1. In FIG. 2, two poles Po, two boundary lines 12, and an equatorial line Eq are depicted. The latitude of each pole Po is 90°, and the latitude of the equatorial line Eq is 0°.

The golf ball 2 has a northern hemisphere N above the equatorial line Eq and a southern hemisphere S below the equatorial line Eq. Each of the northern hemisphere N and the southern hemisphere S has a pole vicinity region 14 and a equator vicinity region 16. The pole vicinity region 14 and the equator vicinity region 16 are adjacent to each other across the boundary line 12. The pole vicinity region 14 is located between the pole Po and the boundary line 12. The equator vicinity region 16 is located between the boundary line 12 and the equatorial line Eq.

Each of the pole vicinity region 14 and the equator vicinity region 16 has a large number of dimples 8. As is obvious from FIG. 2, all the dimples 8 have a circular plane shape. For each dimple 8 that intersects the boundary line 12, the region to which the dimple 8 belongs is determined based on the center position of the dimple 8. The dimple 8 that intersects the boundary line 12 and whose center is located in the pole vicinity region 14 belongs to the pole vicinity region 14. The dimple 8 that intersects the boundary line 12 and whose center is located in the equator vicinity region 16 belongs to the equator vicinity region 16. The center of each dimple 8 is a point at which a straight line passing through the deepest part of the dimple 8 and the center of the golf ball 2 intersects the surface of a phantom sphere. The surface of the phantom sphere is the surface of the golf ball 2 when it is postulated that no dimple 8 exists.

Figure 3:
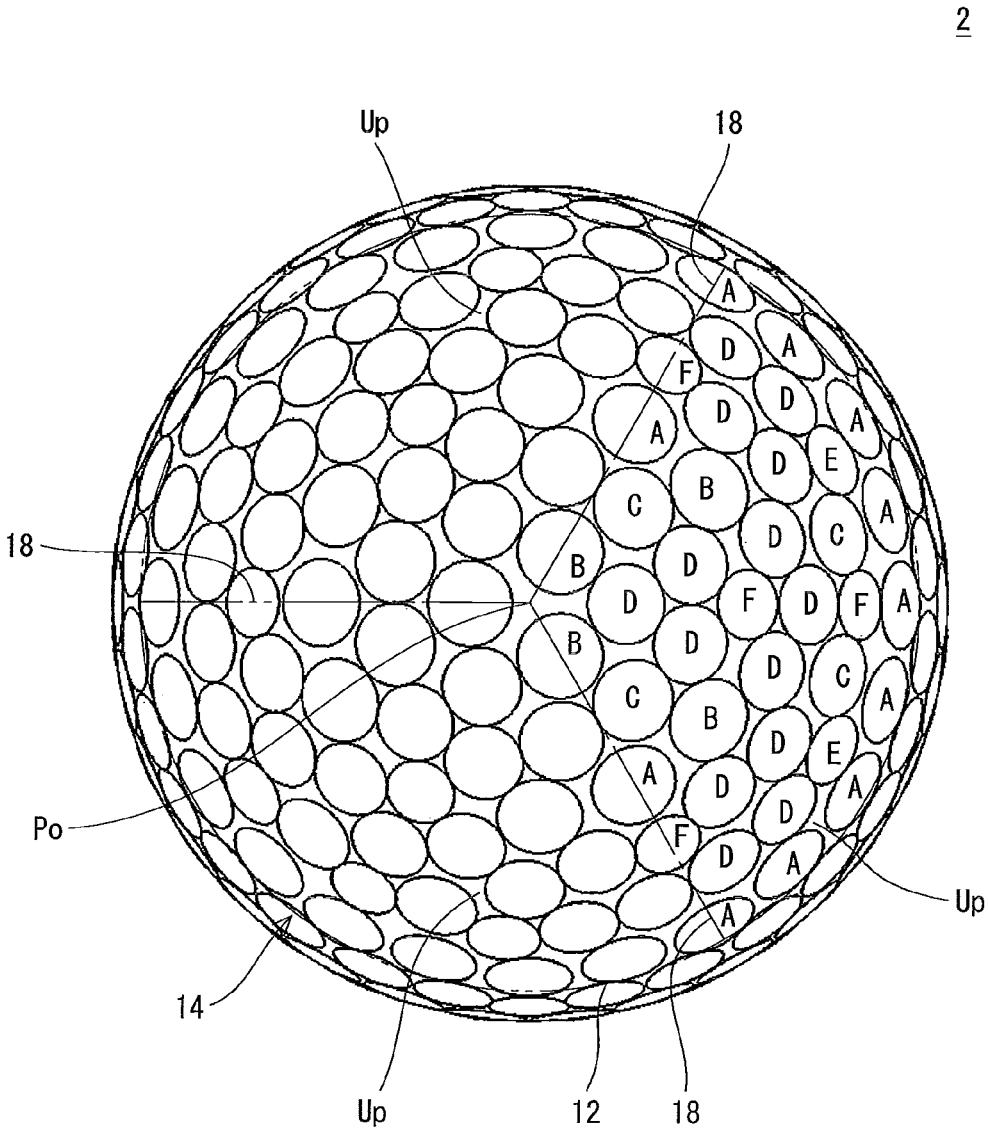
FIG. 3 is a plan view of the golf ball in FIG. 2.

FIG. 3 is a plan view of the golf ball 2 in FIG. 2. FIG. 3 shows three first longitude lines 18 together with the boundary line 12. In FIG. 3, the region surrounded by the boundary line 12 is the pole vicinity region 14. The pole vicinity region 14 can be divided into three units Up. Each unit Up has a spherical triangular shape. The contour of each unit Up consists of the boundary line 12 and two first longitude lines 18. In FIG. 3, for one unit Up, types of the dimples 8 are indicated by the reference letters A, B, C, D, E, and F. The pole vicinity region 14 has dimples A having a diameter of 4.50 mm; dimples B having a diameter of 4.40 mm; dimples C having a diameter of 4.30 mm; dimples D having a diameter of 4.10 mm; dimples E having a diameter of 3.80 mm; and dimples F having a diameter of 3.60 mm.

The dimple patterns of the three units Up have 120° rotational symmetry. In other words, when the dimple pattern of one unit Up is rotated 120° in the latitude direction about the pole Po, it substantially overlaps the dimple pattern of the adjacent unit Up. The state of "substantially overlapping" also includes the state in which a dimple 8 in one unit is shifted to some extent from the corresponding dimple 8 in another unit. The state of "being shifted to some extent" includes the state in which the center of the dimple 8 in one unit is deviated to some extent from the center of the corresponding dimple 8 in another unit. The distance between the center of the dimple 8 in one unit and the center of the corresponding dimple 8 in another unit is preferably equal to or less than 1.0 mm and more preferably equal to or less than 0.5 mm. Here, the state of "being shifted to some extent" includes the state in which the dimension of the dimple 8 in one unit is different to some extent from the dimension of the corresponding dimple 8 in another unit. The difference in dimension is preferably equal to or less than 0.5 mm and more preferably equal to or less than 0.3 mm. The dimension means the length of the longest line segment that can be depicted over the contour of the dimple 8. In the case of a circular dimple 8, the dimension is equal to the diameter of the dimple 8.

Figure 4:
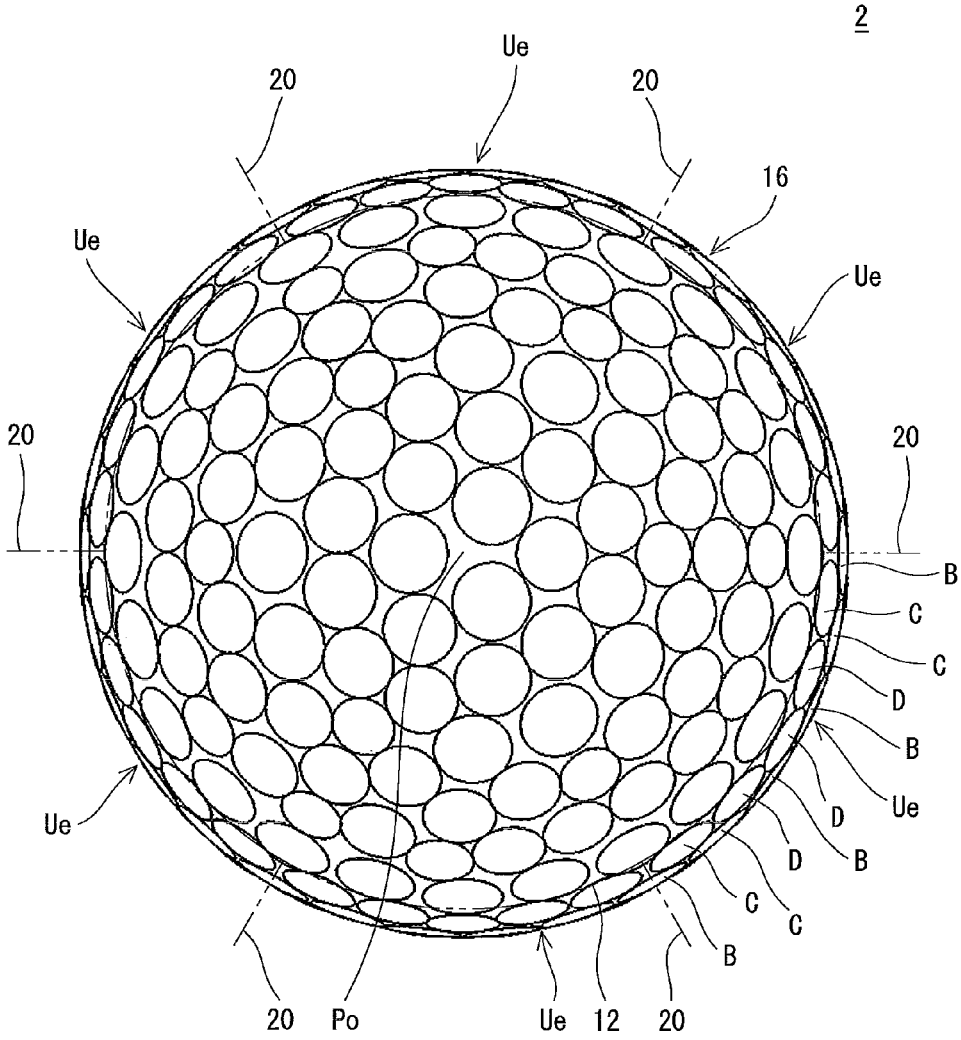
FIG. 4 is a plan view of the golf ball in FIG. 2.

FIG. 4 is a plan view of the golf ball 2 in FIG. 2. FIG. 4 shows six second longitude lines 20 together with the boundary line 12. In FIG. 4, the outside of the boundary line 12 is the equator vicinity region 16. The equator vicinity region 16 can be divided into six units Ue. Each unit Ue has a spherical trapezoidal shape. The contour of each unit Ue consists of the boundary line 12, two second latitude lines 20, and the equatorial line Eq (see FIG. 2). In FIG. 4, for one unit Ue, types of the dimples 8 are indicated by the reference letters B, C, and D. The equator vicinity region 16 has dimples B having a diameter of 4.40 mm; dimples C having a diameter of 4.30 mm; and dimples D having a diameter of 4.10 mm.

The dimple patterns of the six units Ue have 60° rotational symmetry. In other words, when the dimple pattern of one unit Ue is rotated 60° in the latitude direction about the pole Po, it substantially overlaps the dimple pattern of the adjacent unit Ue. The dimple pattern of the equator vicinity region 16 can be also divided into three units. In this case, the dimple patterns of the units have 120° rotational symmetry. The dimple pattern of the equator vicinity region 16 can be also divided into two units. In this case, the dimple patterns of the units have 180° rotational symmetry. The dimple pattern of the equator vicinity region 16 has three rotational symmetry angles (i.e., 60°, 120°, and 180°). The region having a plurality of rotational symmetry angles is divided into units Ue based on the smallest rotational symmetry angle (60° in this case).

In the golf ball 2, the number Np of the units Up of the pole vicinity region 14 is 3, while the number Ne of the units Ue of the equator vicinity region 16 is 6. These numbers are different from each other. The dimple pattern with the number Np and the number Ne being different from each other is varied. In the golf ball 2, air flow is efficiently disturbed during flight. The golf ball 2 has excellent flight performance. Examples of combinations of the number Np and the number Ne (Np, Ne)

include (1, 2), (1, 3), (1, 4), (1, 5), (1, 6), (1, 7), (1, 8), (2, 1), (2, 3), (2, 4), (2, 5), (2, 6), (2, 7), (2, 8), (3, 1), (3, 2), (3, 4), (3, 5), (3, 6), (3, 7), (3, 8), (4, 1), (4, 2), (4, 3), (4, 5), (4, 6), (4, 7), (4, 8), (5, 1), (5, 2), (5, 3), (5, 4), (5, 6), (5, 7), (5, 8), (6, 1), (6, 2), (6, 3), (6, 4), (6, 5), (6, 7), (6, 8), (7, 1), (7, 2), (7, 3), (7, 4), (7, 5), (7, 6), (7, 8), (8, 1), (8, 2), (8, 3), (8, 4), (8, 5), (8, 6) and (8, 7).

In the golf ball 2, the number Ne of the units Ue of the equator vicinity region 16 is a multiple of the number Np of the units Up of the pole vicinity region 14. In a pattern with the number Ne being a multiple of the number Np, dimples 8 can be arranged densely in the vicinity of the boundary line 12. The golf ball 2 with this pattern has excellent flight performance. In a pattern with the number Np being a multiple of the number Ne, dimples 8 can be also arranged densely in the vicinity of the boundary line 12. The golf ball 2 with this pattern also has excellent flight performance. Examples of combinations of the number Np and the number Ne (Np, Ne) include (1, 2), (1, 3), (1, 4), (1, 5), (1, 6), (1, 7), (1, 8), (2, 1), (2, 4), (2, 6), (2, 8), (3, 1), (3, 6), (4, 1), (4, 2), (4, 8), (5, 1), (6, 1), (6, 2), (6, 3), (7, 1), (8, 1), (8, 2), and (8, 4).

In light of dimple effect, preferably, the pole vicinity region 14 has a sufficient area, and the equator vicinity region 16 has a sufficient area. In light of area of the equator vicinity region 16, the latitude of the boundary line 12 is preferably equal to or greater than 20° and more preferably equal to or greater than 25°. In light of area of the pole vicinity region 14, the latitude of the boundary line 12 is preferably equal to or less than 40° and more preferably equal to or less than 35°. The boundary line 12 can be arbitrarily selected from among innumerable latitude lines.

In light of contribution of the pole vicinity region 14 to the dimple effect, the ratio of the number of the dimples 8 that exist in the pole vicinity region 14 to the number of the dimples 8 that exist in the hemisphere is preferably equal to or greater than 20% and more preferably equal to or greater than 30%. This ratio is preferably equal to or less than 70%.

In light of contribution of the equator vicinity region 16 to the dimple effect, the ratio of the number of the dimples 8 that exist in the equator vicinity region 16 to the number of the dimples 8 that exist in the hemisphere is preferably equal to or greater than 20% and more preferably equal to or greater than 30%. This ratio is preferably equal to or less than 70%.

The number Np of the units Up of the pole vicinity region 14 is preferably equal to or greater than 3. In the golf ball 2 with the number Np being 3 or greater, the area of each unit Up is not excessively large. The golf ball 2 has excellent aerodynamic symmetry. The number Np is preferably equal to or less than 6. In the golf ball 2 with the number Np being 6 or less, a superior dimple effect can be achieved.

The number Ne of the units Ue of the equator vicinity region 16 is preferably equal to or greater than 3. In the golf ball 2 with the number Ne being 3 or greater, the area of each unit Ue is not excessively large. The golf ball 2 has excellent aerodynamic symmetry. The number Ne is preferably equal to or less than 6. In the golf ball 2 with the number Ne being 6 or less, a superior dimple effect can be achieved.

From the standpoint that the area of each unit Up and the area of each unit Ue are not excessively large, preferable combinations (Np, Ne) of the number Np and the number Ne are (3, 6) and (6, 3).

In light of aerodynamic symmetry, the dimple pattern of the northern hemisphere N is preferably equivalent to the dimple pattern of the southern hemisphere S. When a pattern that is symmetrical to the dimple pattern of the northern hemisphere N about the plane that includes the equatorial line Eq substantially overlaps the dimple pattern of the southern hemisphere S, these patterns are determined to be equivalent to each other. In addition, when the pattern that is symmetrical to the dimple pattern of the northern hemisphere N about the plane that includes the equatorial line Eq is rotated about the pole Po and the rotated pattern substantially overlaps the dimple pattern of the southern hemisphere S, these patterns are determined to be equivalent to each other.

The dimples 8 that intersect the equatorial line Eq and whose centers are located in the northern hemisphere N belong to the northern hemisphere N. The dimples 8 that intersect the equatorial line Eq and whose centers are located in the southern hemisphere S belong to the southern hemisphere S. The dimples 8 whose latitudes are zero belong to the northern hemisphere N and the southern hemisphere S.

From the standpoint that a sufficient dimple effect is achieved, the total number of the dimples 8 is preferably equal to or greater than 200 and particularly preferably equal to or greater than 260. From the standpoint that each dimple 8 can have a sufficient diameter, the total number is preferably equal to or less than 600, more preferably equal to or less than 500, and particularly preferably equal to or less than 400.

Figure 5:
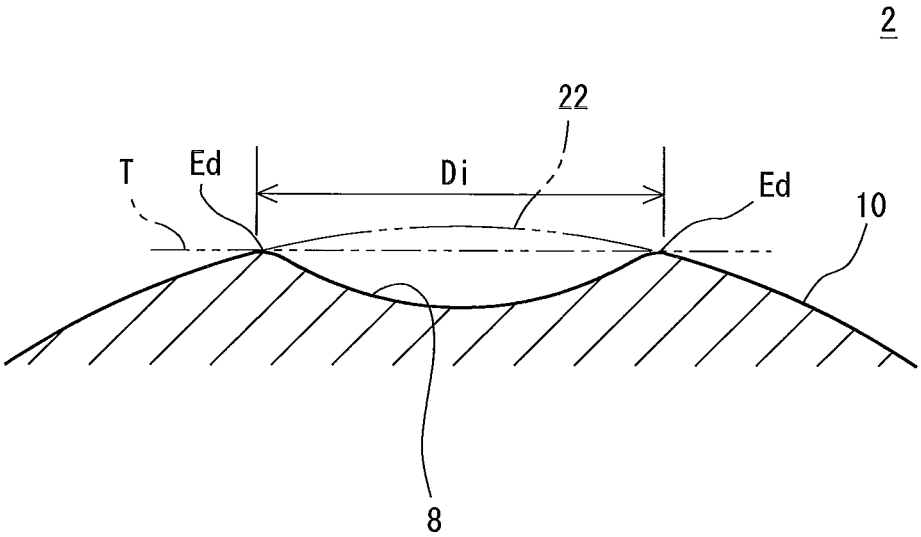
FIG. 5 is a partially enlarged cross-sectional view of the golf ball in FIG. 1.

FIG. 5 shows a cross section along a plane passing through the deepest part of the dimple 8 and the center of the golf ball 2. In FIG. 5, the top-to-bottom direction is the depth direction of the dimple 8. What is indicated by the chain double-dashed line 22 in FIG. 5 is the surface of the phantom sphere 22. The dimple 8 is recessed from the surface of the phantom sphere 22. The land 10 agrees with the surface of the phantom sphere 22.

In FIG. 5, what is indicated by the double ended arrow Di is the diameter of the dimple 8. The diameter Di is the distance between two tangent points Ed appearing on a tangent line T that is drawn tangent to the far opposite ends of the dimple 8. Each tangent point Ed is also the edge of the dimple 8. The edge Ed defines the contour of the dimple 8. The diameter Di is preferably equal to or greater than 2.00 mm and equal to or less than 6.00 mm. By setting the diameter Di to be 2.00 mm or greater, a superior dimple effect is achieved. In this respect, the diameter Di is more preferably equal to or greater than 2.20 mm and particularly preferably equal to or greater than 2.40 mm. By setting the diameter Di to be 6.00 mm or less, a fundamental feature of the golf ball 2 being substantially a sphere is not impaired. In this respect, the diameter Di is more preferably equal to or less than 5.80 mm and particularly preferably equal to or less than 5.60 mm.

The standard deviation Σ of the diameters of all the dimples 8 is preferably equal to or less than 0.30. In the golf ball 2 with the standard deviation Σ being 0.30 or less, an appropriate lift force is obtained. In this respect, the standard deviation Σ is more preferably equal to or less than 0.28 and particularly preferably equal to or less than 0.26. The standard deviation Σ may be zero. In the golf ball 2 shown in FIGS. 1 to 5, the average diameter of the dimples 8 is 4.22 mm. Thus, the standard deviation Σ of the golf ball 2 is calculated by the following mathematical formula.

$$\Sigma=(((4.50-4.22)^2*54+(4.40-4.22)^2*54+(4.30-4.22)^2*72+(4.10-4.22)^2*120)+(3.80-4.22)^2*12+(3.60-4.22)^2*18/330)^{1/2}$$

The standard deviation Σ of the golf ball 2 is 0.23.

The area s of the dimple 8 is the area of a region surrounded by the contour line when the center of the golf ball 2 is viewed at infinity. In the case of a circular dimple 8, the area s is calculated by the following mathematical formula.

$$s=(Di/2)^2*\pi$$

In the golf ball 2 shown in FIGS. 1 to 5, the area of the dimple A is 15.90 $mm^2$; the area of the dimple B is 15.21 $mm^2$; the area of the dimple C is 14.52 $mm^2$; the area of the dimple D is 13.20 $mm^2$; the area of the dimple E is 11.34 $mm^2$; and the area of the dimple F is 10.18 $mm^2$.

In the present invention, the ratio of the sum of the areas of all the dimples 8 to the surface area of the phantom sphere 22 is referred to as an occupation ratio. From the standpoint that a sufficient dimple effect is achieved, the occupation ratio is preferably equal to or greater than 70%, more preferably equal to or greater than 78%, and particularly preferably equal to or greater than 80%. The occupation ratio is preferably equal to or less than 90%. In the golf ball 2 shown in FIGS. 1 to 5, the total area of all the dimples 8 is 4628.7 $mm^2$. The surface area of the phantom sphere 22 of the golf ball 2 is 4629 $mm^2$, and thus the occupation ratio is 81%.

In the present invention, the term "dimple volume" means the volume of a part surrounded by the surface of the dimple 8 and a plane that includes the contour of the dimple 8. In light of suppression of rising of the golf ball 2 during flight, the total volume of all the dimples 8 is preferably equal to or greater than 250 $mm^3$, more preferably equal to or greater than 260 $mm^3$, and particularly preferably equal to or greater than 270 $mm^3$. In light of suppression of dropping of the golf ball 2 during flight, the total volume is preferably equal to or less than 400 $mm^3$, more preferably equal to or less than 390 $mm^3$, and particularly preferably equal to or less than 380 $mm^3$.

In light of suppression of rising of the golf ball 2 during flight, the depth of the dimple 8 is preferably equal to or greater than 0.05 mm, more preferably equal to or greater than 0.08 mm, and particularly preferably equal to or greater than 0.10 mm. In light of suppression of dropping of the golf ball 2 during flight, the depth of the dimple 8 is preferably equal to or less than 0.60 mm, more preferably equal to or less than 0.45 mm, and particularly preferably equal to or less than 0.40 mm. The depth is the distance between the tangent line T and the deepest part of the dimple 8.

The depth of each dimple 8 in the equator vicinity region 16 is preferably larger than the depth of each dimple 8 in the pole vicinity region 14. The golf ball has excellent aerodynamic symmetry. In light of aerodynamic symmetry, the difference between the average depth of the dimples 8 in the equator vicinity region 16 and the average depth of the dimples 8 in the pole vicinity region 14 is preferably equal to or greater than 0.004 mm and equal to or less than 0.020 mm, more preferably equal to or greater than 0.005 mm and equal to or less than 0.019 mm, and particularly preferably equal to or greater than 0.006 mm and equal to or less than 0.018 mm.

Figure 6:
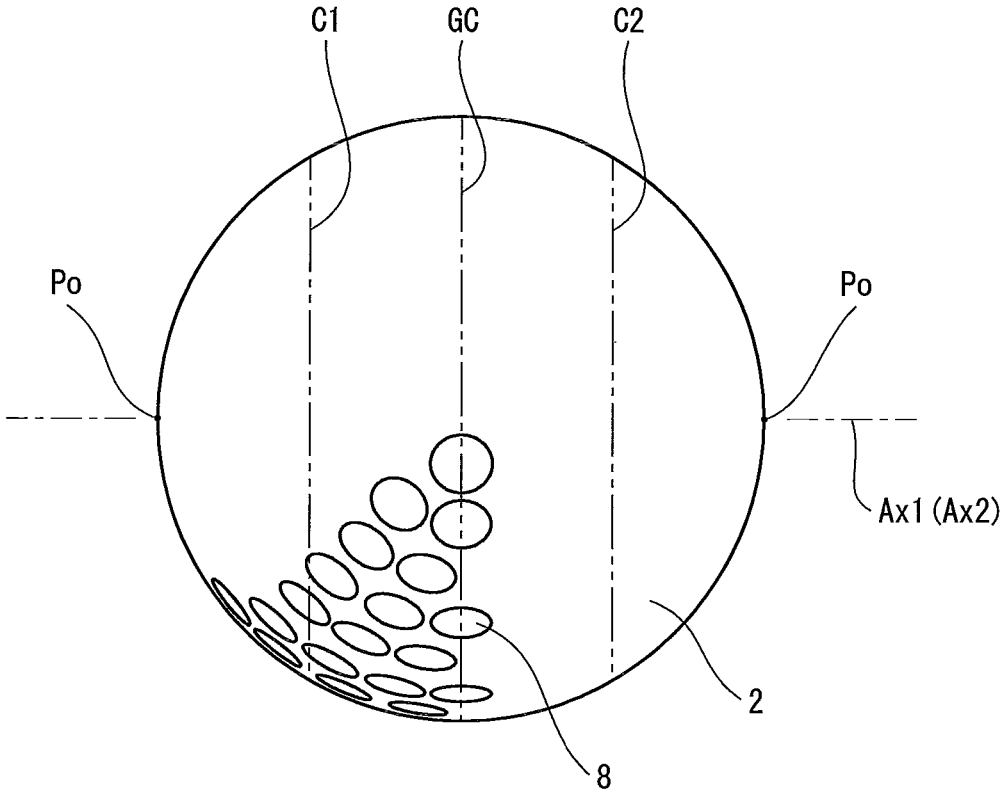
FIG. 6 is a schematic view for illustrating a method of calculating a peak value.

In the golf ball, the sum (Ps+Pp) of a peak value Ps and a peak value Pp is equal to or greater than 600 mm. The following will describe a method of calculating the peak value Ps and the peak value Pp. As shown in FIG. 6, in this calculation method, a first rotation axis Ax1 is assumed. The first rotation axis Ax1 passes through the two poles Po of the golf ball 2. The golf ball 2 rotates about the first rotation axis Ax1. This rotation is referred to as PH rotation.

Figure 7:
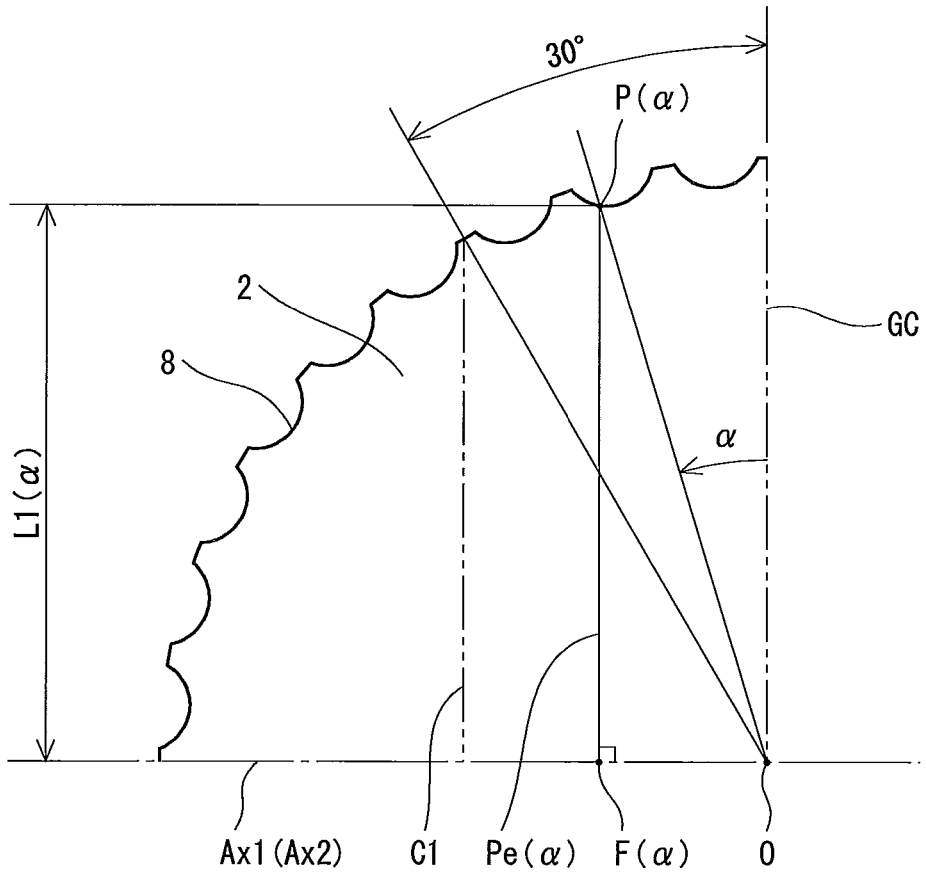
FIG. 7 is a partial schematic view of the golf ball in FIG. 6.

There is assumed a great circle GC that exists on the surface of the phantom sphere 22 of the golf ball 2 and is orthogonal to the first rotation axis Ax1. The circumferential speed of the great circle GC is faster than any other part of the golf ball 2 during rotation of the golf ball 2. In addition, there are assumed two small circles C1 and C2 that exist on the surface of the phantom sphere 22 of the golf ball 2 and are orthogonal to the first rotation axis Ax1. FIG. 7 schematically shows a partial cross-sectional view of the golf ball 2 in FIG. 6. In FIG. 7, the right-to-left direction is the direction of the first rotation axis Ax1. As shown in FIG. 7, the absolute value of the central angle between the small circle C1 and the great circle GC is 30°. Although not shown in the drawing, the absolute value of the central angle between the small circle C2 and the great circle GC is also 30°. The golf ball 2 is divided at the small circles C1 and C2, and of the surface of the golf ball 2, a region sandwiched between the small circles C1 and C2 is defined.

In FIG. 7, a point P(α) is the point that is located on the surface of the golf ball 2 and of which the central angle with the great circle GC is α° (degree). A point F(α) is a foot of a perpendicular line Pe(α) that extends downward from the point P(α) to the first rotation axis Ax1. What is indicated by the arrow L1(α) is the length of the perpendicular line Pe(α). In other words, the length L1(α) is the distance between the point P(α) and the first rotation axis Ax1. For one cross section, the lengths L1(α) are calculated at 21 points P(α). Specifically, the lengths L1(α) are calculated at angles α of −30°, −27°, −24°, −21°, −18°, −15°, −12°, −9°, −6°, −3°, 0°, 3°, 6°, 9°, 12°, 15°, 18°, 21°, 24°, 27°, and 30°. The 21 lengths L1(α) are summed to obtain a total length L2 (mm). The total length L2 is a parameter dependent on the surface shape in the cross section shown in FIG. 7.

Figure 8:
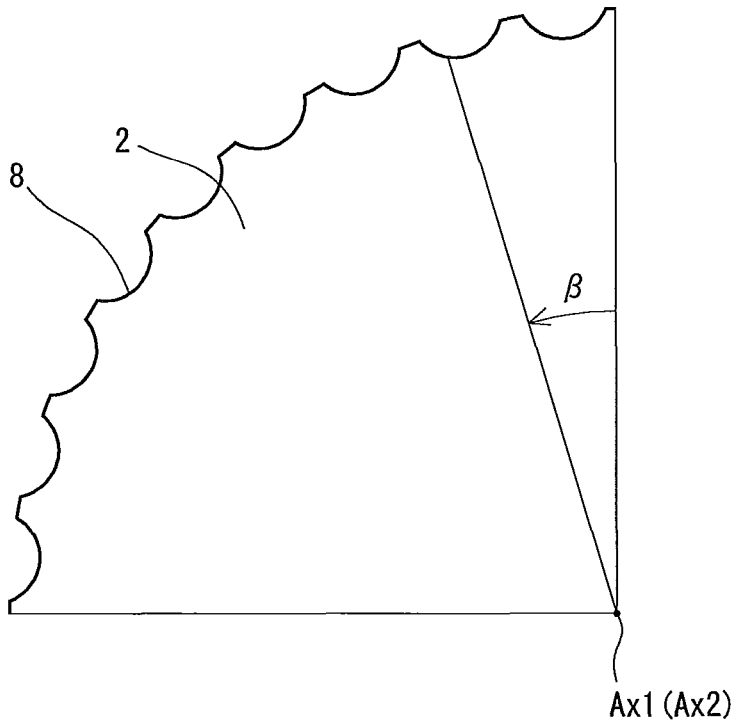
FIG. 8 is a partial schematic view of the golf ball in FIG. 6.

FIG. 8 shows a partial cross section of the golf ball 2. In FIG. 8, a direction perpendicular to the surface of the sheet is the direction of the first rotation axis Ax1. In FIG. 8, what is indicated by the reference sign β is a rotation angle of the golf ball 2. In a range equal to or greater than 0° and smaller than 360°, the rotation angles β are set at intervals of an angle of 0.25°. At each rotation angle, the total length L2 is calculated. As a result, 1440 total lengths L2 are obtained along the rotation direction. In other words, a first data constellation regarding a parameter dependent on a surface shape appearing at a predetermined point moment by moment during one rotation of the golf ball 2, is calculated. This data constellation is calculated on the basis of the 30240 lengths L1.

Figure 9:
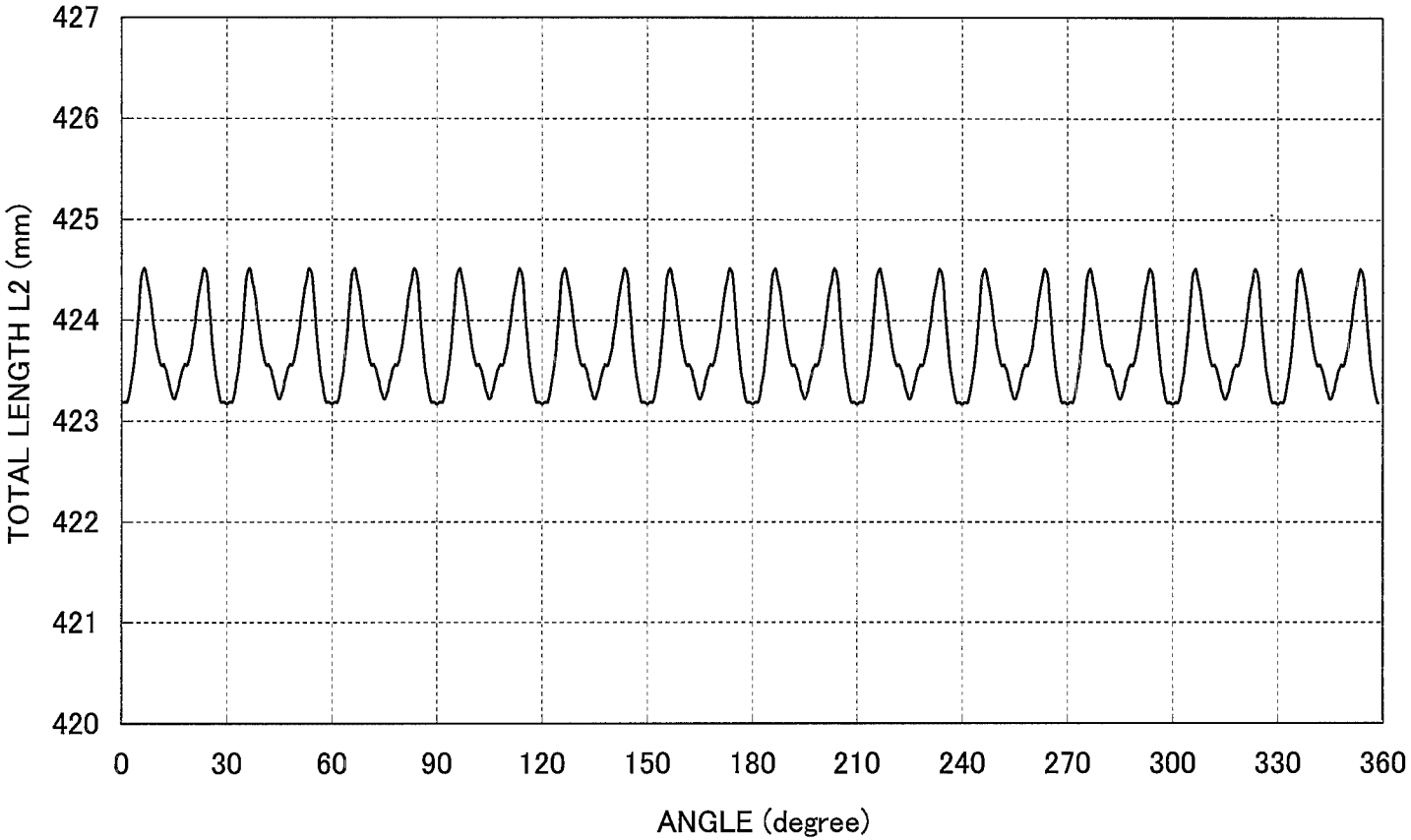
FIG. 9 is a graph showing an evaluation result of the golf ball in FIG. 3.

FIG. 9 shows a graph plotting the first data constellation of the golf ball 2 shown in FIGS. 3 to 5. In this graph, the horizontal axis indicates the rotation angle β, and the vertical axis indicates the total length L2. Fourier transformation is performed on the first data constellation. By the Fourier transformation, a frequency spectrum is obtained. In other words, by the Fourier transformation, a coefficient of a Fourier series represented by the following mathematical formula is obtained.

$$F_k = \sum_{n=0}^{N-1} \left( a_n \cos 2\pi \frac{nk}{N} + b_n \sin 2\pi \frac{nk}{N} \right)$$

The above mathematical formula is a combination of two trigonometric functions having different periods. In the above mathematical formula, $a_n$ and $b_n$ are Fourier coefficients. The magnitude of each component synthesized is determined depending on these Fourier coefficients. Each coefficient is represented by the following mathematical formulas.

$$a_n = \frac{1}{N} \sum_{k=0}^{N-1} F_k \cos 2\pi \frac{nk}{N}$$

$$b_n = \frac{1}{N} \sum_{k=0}^{N-1} F_k \sin 2\pi \frac{nk}{N}$$

In these mathematical formulas, N is the total number of pieces of data of the first data constellation, and $F_k$ is the kth value in the first data constellation. The spectrum is represented by the following mathematical formula.

$$P_n=\sqrt{a_n^2+b_n^2}$$

Figure 10:
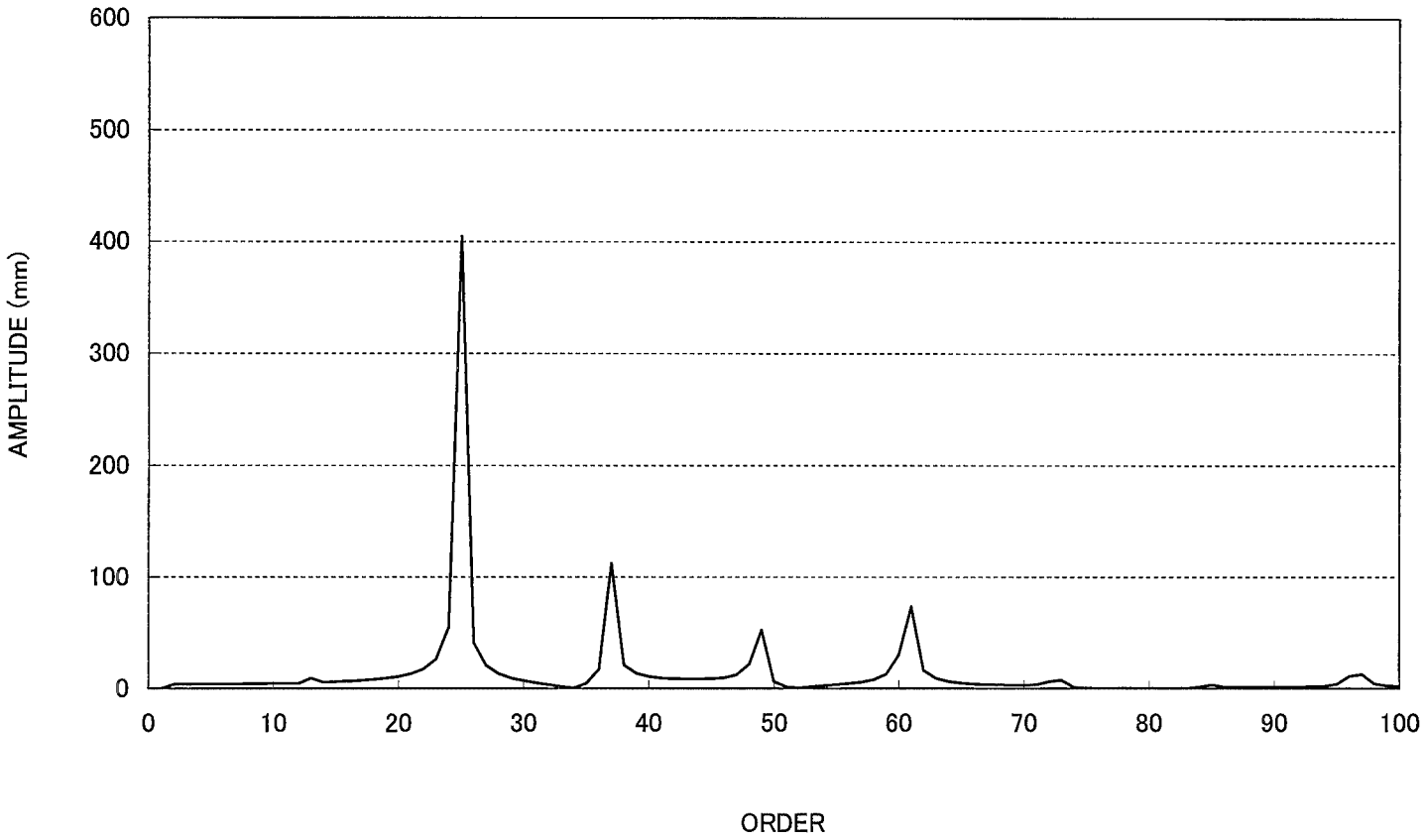
FIG. 10 is a graph showing another evaluation result of the golf ball in FIG. 3.

By the Fourier transformation, a first transformed data constellation is obtained. FIG. 10 shows a graph plotting the first transformed data constellation. In this graph, the horizontal axis indicates an order, and the vertical axis indicates an amplitude. On the basis of this graph, the maximum peak is determined. Further, the peak value Ps of the maximum peak and the order Fs of the maximum peak are determined. The peak value Ps and the order Fs are numeric values indicating the aerodynamic characteristic during PH rotation.

Moreover, a second rotation axis Ax2 orthogonal to the first rotation axis Ax1 is determined. Rotation of the golf ball 2 about the second rotation axis Ax2 is referred to as POP rotation. Similarly as for PH rotation, for POP rotation, a great circle GC and two small circles C1 and C2 are assumed. The absolute value of the central angle between the small circle C1 and the great circle GC is 30°. The absolute value of the central angle between the small circle C2 and the great circle GC is also 30°. For a region, sandwiched between the small circles C1 and C2, of the surface of the golf ball 2, 1440 total lengths L2 are calculated. In other words, a second data constellation regarding a parameter dependent on a surface shape appearing at a predetermined point moment by moment during one rotation of the golf ball 2, is calculated.

Figure 11:
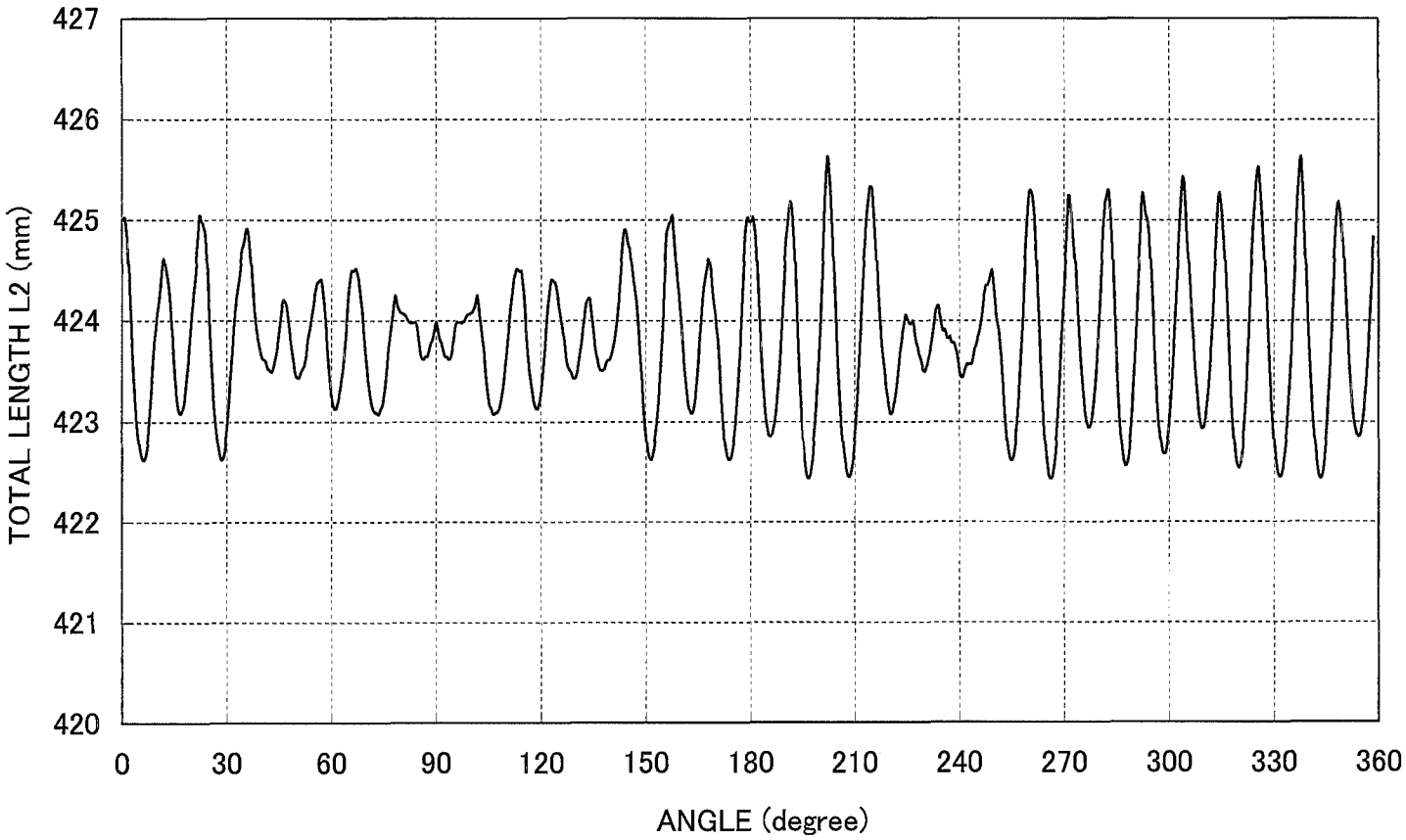
FIG. 11 is a graph showing another evaluation result of the golf ball in FIG. 3.
Figure 12:
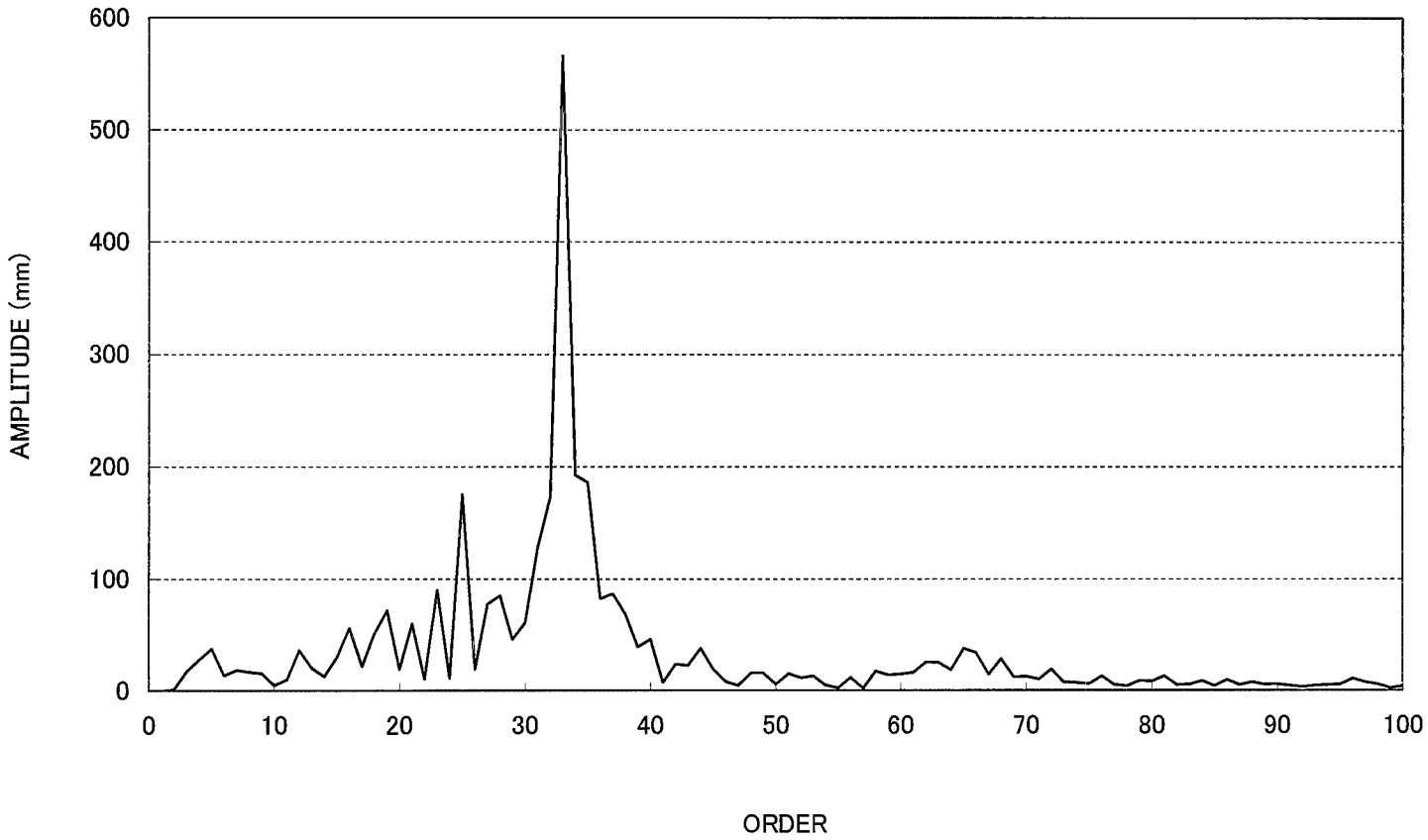
FIG. 12 is a graph showing another evaluation result of the golf ball in FIG. 3.

FIG. 11 shows a graph plotting the second data constellation of the golf ball 2 shown in FIGS. 3 to 5. In this graph, the horizontal axis indicates the rotation angle β, and the vertical axis indicates the total length L2. Fourier transformation is performed on the second data constellation to obtain a second transformed data constellation. FIG. 12 shows a graph plotting the second transformed data constellation. In this graph, the horizontal axis indicates an order, and the vertical axis indicates an amplitude. On the basis of this graph, the maximum peak is determined. Further, the peak value Pp of the maximum peak and the order Fp of the maximum peak are determined. The peak value Pp and the order Fp are numeric values indicating the aerodynamic characteristic during POP rotation.

As is obvious from FIGS. 9 to 12, the Fourier transformation facilitates comparison of the aerodynamic characteristic during PH rotation and the aerodynamic characteristic during POP rotation.

There are numerous straight lines orthogonal to the first rotation axis Ax1. Thus, there are many candidates for the great circle GC for POP rotation. A first great circle that contains the most number of dimples that centrally intersect the first great circle is determined from among these candidates. In addition, a second great circle having a longitude that is different from the longitude of the first great circle by 90° is determined. A straight line orthogonal to the plane that includes the second great circle is the second rotation axis Ax2. The term "to centrally intersect" means a state in which the plane that includes the great circle passes through the center of a dimple. When there are in reality a plurality of first great circles, there are a plurality of second great circles, and there are a plurality of second rotation axes Ax2. In this case, the peak value is calculated for each of the second rotation axes Ax2. The maximum value of these peak values is the peak value Pp.

The following shows results, of the golf ball 2 shown in FIGS. 3 to 5, calculated by the above evaluation method.

PH Rotation
Peak value Ps: 405 mm
Order Fs: 25

POP Rotation
Peak value Pp: 566 mm
Order Fp: 33
Sum (Ps+Pp): 971 mm

The sum (Ps+Pp) correlates with the flight performance of the golf ball 2. The golf ball 2 with the sum (Ps+Pp) being 600 mm or greater has excellent flight performance. This is because air flow is appropriately disturbed. In light of flight performance, the sum (Ps+Pp) is more preferably equal to or greater than 637 mm and particularly preferably equal to or greater than 716 mm.

If the sum (Ps+Pp) is excessively great, the dimple effect is insufficient. In this respect, the sum (Ps+Pp) is preferably equal to or less than 1000 mm, more preferably equal to or less than 971 mm, and particularly preferably equal to or less than 825 mm.

The golf ball 2 with the difference between the aerodynamic characteristic during PH rotation and the aerodynamic characteristic during POP rotation being small, has excellent aerodynamic symmetry. In light of aerodynamic symmetry, the absolute value of the difference (Ps−Pp) between the peak value Ps and the peak value Pp is preferably equal to or less than 250 mm, more preferably equal to or less than 225 mm, and particularly preferably equal to or less than 200 mm.

The order Fs is preferably equal to or greater than 20 and equal to or less than 40. In the golf ball 2 with the order Fs in this range, a superior dimple effect can be achieved. In this respect, the order Fs is more preferably equal to or greater than 22 and particularly preferably equal to or greater than 33. The order Fs is more preferably equal to or less than 38 and particularly preferably equal to or less than 37.

The order Fp is preferably equal to or greater than 20 and equal to or less than 40. In the golf ball 2 with the order Fp in this range, a superior dimple effect can be achieved. In this respect, the order Fp is more preferably equal to or greater than 22 and particularly preferably equal to or greater than 33. The order Fp is more preferably equal to or less than 38 and particularly preferably equal to or less than 37.

In light of aerodynamic symmetry, the absolute value of the difference (Fs−Fp) between the order Fs and the order Fp is preferably equal to or less than 10, more preferably equal to or less than 9, and particularly preferably equal to or less than 8.

EXAMPLES

Example 1

A rubber composition was obtained by kneading 100 parts by weight of a polybutadiene (trade name "BR-730", available from JSR Corporation), 30 parts by weight of zinc diacrylate, 6 parts by weight of zinc oxide, 10 parts by weight of barium sulfate, 0.5 parts by weight of diphenyl disulfide, and 0.5 parts by weight of dicumyl peroxide. This rubber composition was placed into a mold including upper and lower mold halves each having a hemispherical cavity, and heated at 170° C. for 18 minutes to obtain a core with a diameter of 39.7 mm. On the other hand, a resin composition was obtained by kneading 50 parts by weight of an ionomer resin (trade name "Himilan 1605", available from Du Pont-MITSUI POLYCHEMICALS Co., LTD.), 50 parts by weight of another ionomer resin (trade name "Himilan 1706", available from Du Pont-MITSUI POLYCHEMICALS Co., LTD.), and 3 parts by weight of titanium dioxide. The above core was placed into a final mold having numerous pimples on its inside face, followed by injection of the above resin composition around the core by injection molding, to form a cover with a thickness of 1.5 mm. Numerous dimples having a shape that was the inverted shape of the pimples were formed on the cover. A clear paint including a two-component curing type polyurethane as a base material was applied to this cover to obtain a golf ball of Example 1 with a diameter of 42.7 mm and a weight of about 45.4 g. The golf ball has a PGA compression of about 85. The golf ball has a dimple pattern shown in FIGS. 13 and 14. In this dimple pattern, each of the northern hemisphere and the southern hemisphere has six units. The detailed specifications of the dimples are shown in the following Table 1. The peak values and the orders of this golf ball were measured by the above method. The results are shown in the following Table 3.

Example 2

A golf ball of Example 2 was obtained in a similar manner as Example 1, except the final mold was changed. This golf ball has a dimple pattern shown in FIGS. 15 and 16. In this dimple pattern, each equator vicinity region has six units, and each pole vicinity region has three units. The latitude of each boundary line is 23°. The detailed specifications of the dimples are shown in the following Table 1. The peak values and the orders are shown in the following Table 3.

Example 3

A golf ball of Example 3 was obtained in a similar manner as Example 1, except the final mold was changed. This golf ball has the dimple pattern shown in FIGS. 2 and 3. In this dimple pattern, each equator vicinity region has six units, and each pole vicinity region has three units. The latitude of each boundary line is 23°. The detailed specifications of the dimples are shown in the following Table 1. The peak values and the orders are shown in the following Table 3.

Example 4

A golf ball of Example 4 was obtained in a similar manner as Example 1, except the final mold was changed. This golf ball has a dimple pattern shown in FIGS. 17 and 18. In this dimple pattern, each equator vicinity region has six units, and each pole vicinity region has three units. The latitude of each boundary line is 23°. The detailed specifications of the dimples are shown in the following Table 1. The peak values and the orders are shown in the following Table 3.

Example 5

A golf ball of Example 5 was obtained in a similar manner as Example 1, except the final mold was changed. This golf ball has a dimple pattern shown in FIGS. 19 and 20. In this dimple pattern, each of the northern hemisphere and the southern hemisphere has three units. The detailed specifications of the dimples are shown in the following Table 1. The peak values and the orders are shown in the following Table 3.

Comparative Example 1

Figure 21:
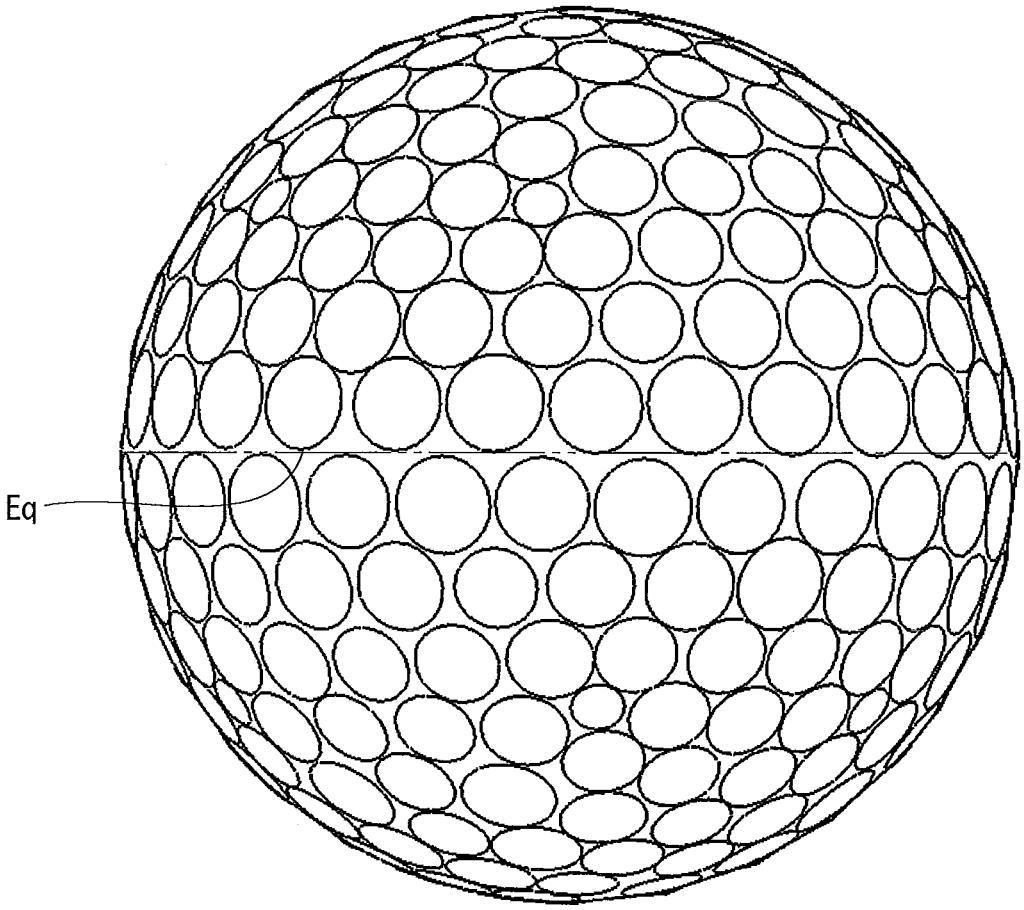
FIG. 21 is a front view of a golf ball according to Comparative Example 1.
Figure 22:
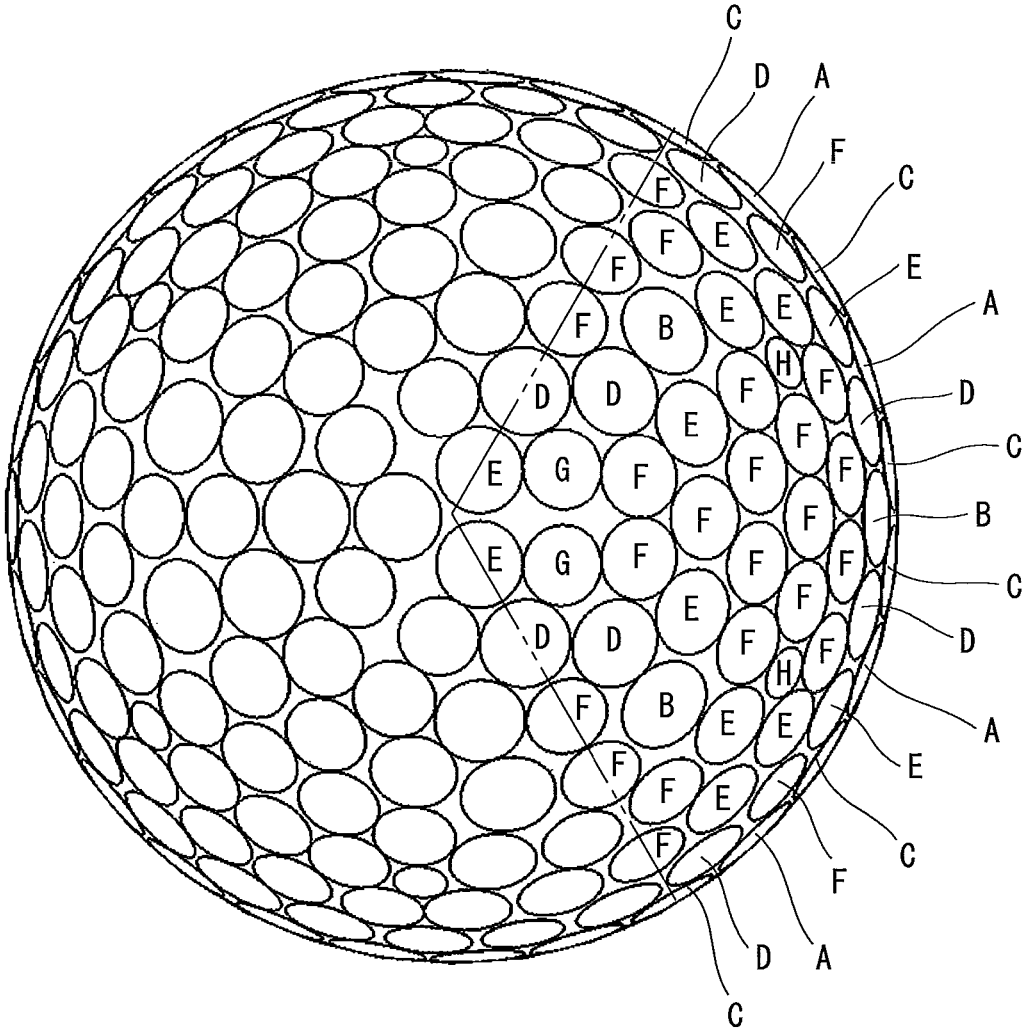
FIG. 22 is a plan view of the golf ball in FIG. 21.

A golf ball of Comparative Example 1 was obtained in a similar manner as Example 1, except the final mold was changed. This golf ball has a dimple pattern shown in FIGS. 21 and 22. In this dimple pattern, each of the northern hemisphere and the southern hemisphere has three units. The detailed specifications of the dimples are shown in the following Table 2. The peak values and the orders are shown in the following Table 4.

Comparative Example 2

Figure 23:
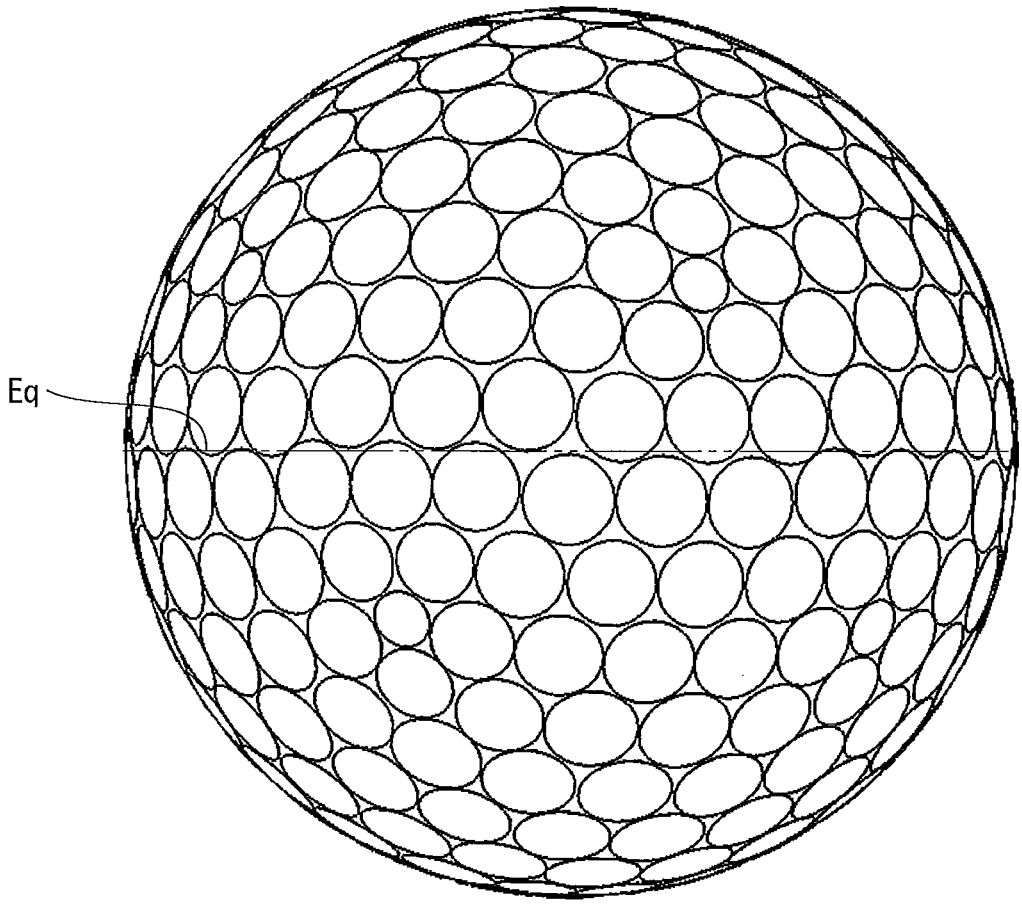
FIG. 23 is a front view of a golf ball according to Comparative Example 2.
Figure 24:
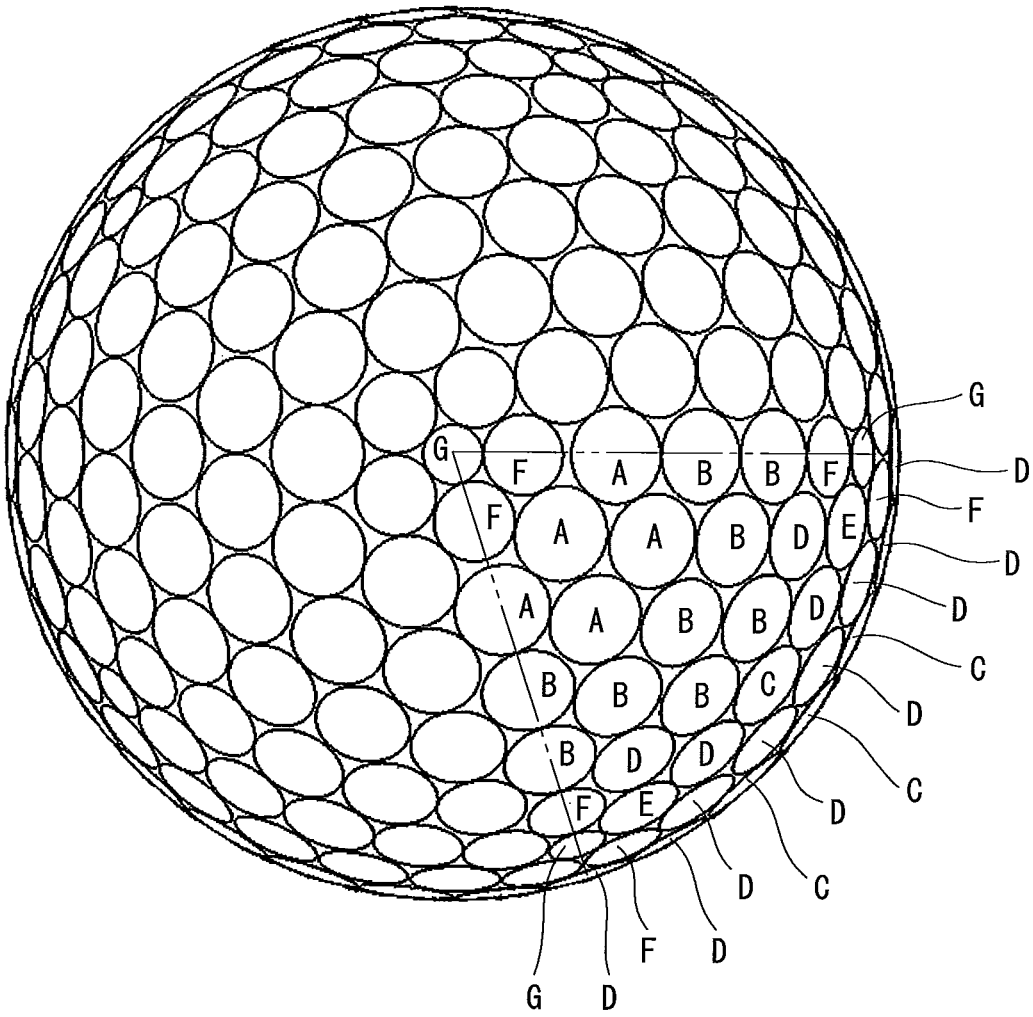
FIG. 24 is a plan view of the golf ball in FIG. 23.

A golf ball of Comparative Example 2 was obtained in a similar manner as Example 1, except the final mold was changed. This golf ball has a dimple pattern shown in FIGS. 23 and 24. In this dimple pattern, each of the northern hemisphere and the southern hemisphere has five units. The detailed specifications of the dimples are shown in the following Table 2. The peak values and the orders are shown in the following Table 4.

Comparative Example 3

Figure 25:
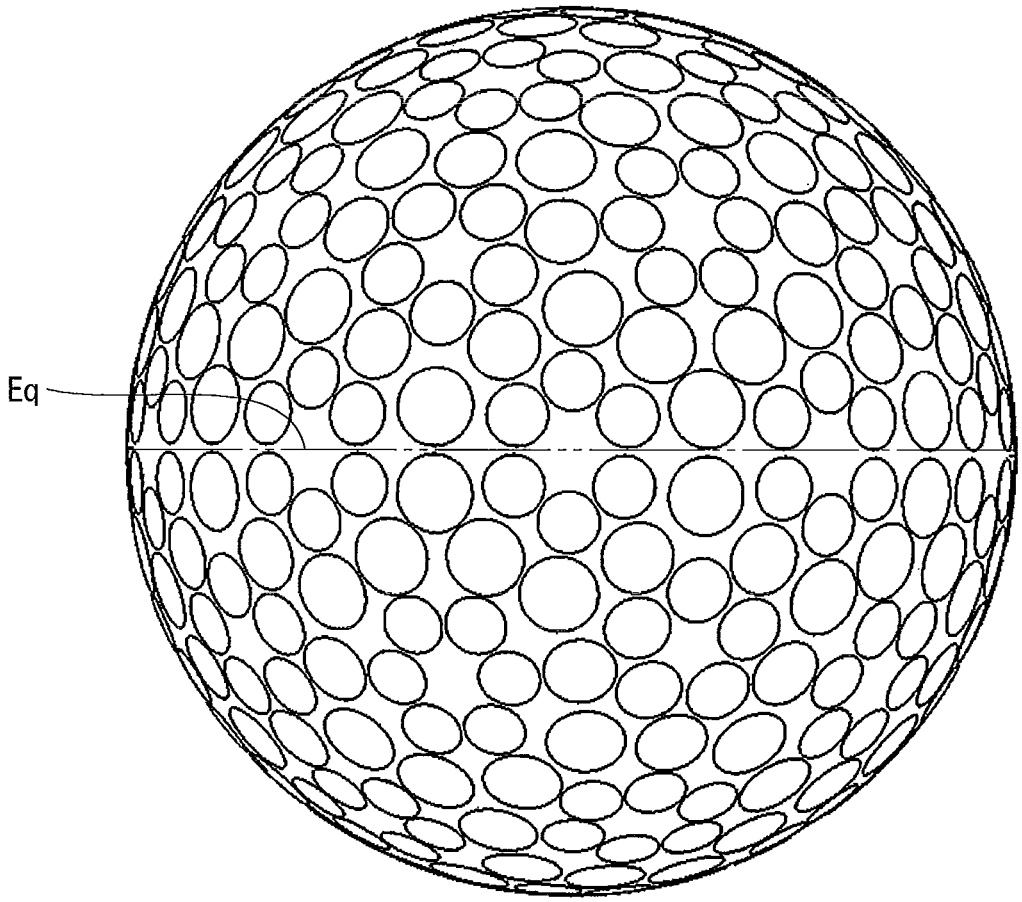
FIG. 25 is a front view of a golf ball according to Comparative Example 3.
Figure 26:
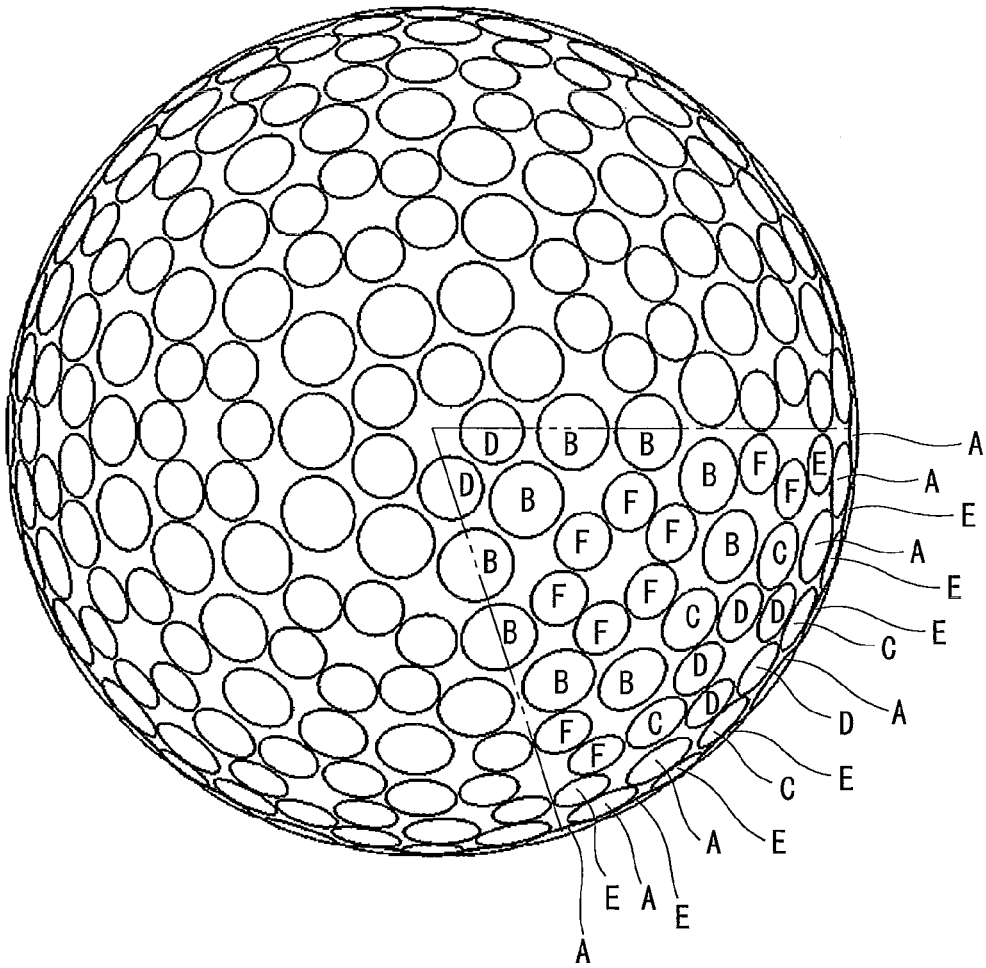
FIG. 26 is a plan view of the golf ball in FIG. 25.

A golf ball of Comparative Example 3 was obtained in a similar manner as Example 1, except the final mold was changed. This golf ball has a dimple pattern shown in FIGS. 25 and 26. In this dimple pattern, each of the northern hemisphere and the southern hemisphere has five units. The detailed specifications of the dimples are shown in the following Table 2. These dimples are of a so-called double radius type. The peak values and the orders are shown in the following Table 4.

Comparative Example 4

Figure 27:
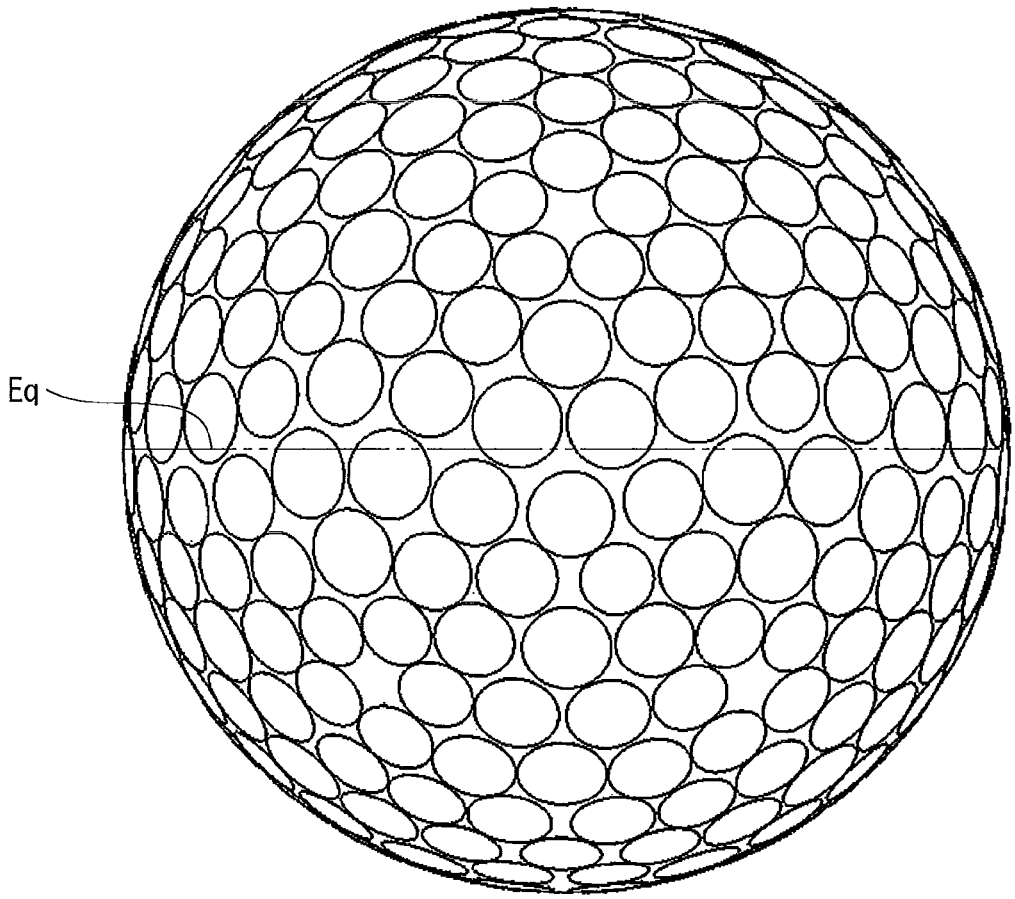
FIG. 27 is a front view of a golf ball according to Comparative Example 4.

A golf ball of Comparative Example 4 was obtained in a similar manner as Example 1, except the final mold was changed. This golf ball has a dimple pattern shown in FIGS. 27 and 28. In this dimple pattern, each of the northern hemisphere and the southern hemisphere has three units. The detailed specifications of the dimples are shown in the following Table 2. The peak values and the orders are shown in the following Table 4.

[Flight Distance Test]

A driver with a titanium head (Trade name "XXIO", available from SRI SPORTS, Ltd., shaft hardness: X, loft angle: 9°) was attached to a swing machine available from Golf Laboratories, Inc. A golf ball was hit under the conditions of: a head speed of 49 m/sec; a launch angle of about 11°; and a backspin rotation rate of about 3000 rpm, and the distance from the launch point to the stop point was measured. At the test, the weather was almost windless. The measurement was done 10 times for PH rotation, and the measurement was done 10 times for POP rotation. The average values of 20 measurements are shown in the following Tables 3 and 4.

TABLE 1

Results of Evaluation

| | | Number | Diameter (mm) | Depth (mm) | Depth of spherical surface (mm) | Radius of curvature(mm) | Volume ($mm^3$) |
|---|---|---|---|---|---|---|---|
| Example 1 | A | 132 | 4.400 | 0.154 | 0.268 | 15.79 | 1.173 |
| | B | 96 | 4.300 | 0.154 | 0.263 | 15.09 | 1.120 |
| | C | 74 | 4.100 | 0.154 | 0.253 | 13.72 | 1.019 |
| | D | 24 | 3.600 | 0.154 | 0.230 | 10.60 | 0.786 |

TABLE 1-continued

| Results of Evaluation | | | | | | | |
|---|---|---|---|---|---|---|---|
| | | Number | Diameter (mm) | Depth (mm) | Depth of spherical surface (mm) | Radius of curvature(mm) | Volume ($mm^3$) |
| Example 2 | A | 36 | 4.500 | 0.155 | 0.274 | 16.41 | 1.235 |
| | B | 90 | 4.400 | 0.155 | 0.269 | 15.69 | 1.180 |
| | C | 78 | 4.300 | 0.155 | 0.264 | 14.99 | 1.127 |
| | D | 84 | 4.100 | 0.155 | 0.254 | 13.63 | 1.025 |
| | E | 24 | 3.800 | 0.155 | 0.240 | 11.72 | 0.881 |
| | F | 12 | 3.600 | 0.155 | 0.231 | 10.53 | 0.791 |
| Example 3 | A | 54 | 4.500 | 0.153 | 0.272 | 16.62 | 1.219 |
| | B | 54 | 4.400 | 0.153 | 0.267 | 15.89 | 1.165 |
| | C | 72 | 4.300 | 0.153 | 0.262 | 15.18 | 1.113 |
| | D | 120 | 4.100 | 0.153 | 0.252 | 13.81 | 1.012 |
| | E | 12 | 3.800 | 0.153 | 0.238 | 11.87 | 0.869 |
| | F | 18 | 3.600 | 0.153 | 0.229 | 10.66 | 0.781 |
| Example 4 | A | 18 | 4.500 | 0.153 | 0.272 | 16.62 | 1.219 |
| | B | 72 | 4.400 | 0.153 | 0.267 | 15.89 | 1.165 |
| | C | 72 | 4.300 | 0.153 | 0.262 | 15.18 | 1.113 |
| | D | 132 | 4.100 | 0.153 | 0.252 | 13.81 | 1.012 |
| | E | 24 | 3.800 | 0.153 | 0.238 | 11.87 | 0.869 |
| | F | 18 | 3.600 | 0.153 | 0.229 | 10.66 | 0.781 |
| Example 5 | A | 264 | 4.000 | 0.162 | 0.256 | 12.43 | 1.020 |
| | B | 96 | 3.750 | 0.162 | 0.244 | 10.93 | 0.897 |

TABLE 2

| Results of Evaluation | | | | | | | |
|---|---|---|---|---|---|---|---|
| | | Number | Diameter (mm) | Depth (mm) | Depth of spherical surface (mm) | Radius of curvature (mm) | Volume ($mm^3$) |
| Compa. Example 1 | A | 24 | 4.700 | 0.190 | 0.3197 | 14.63 | 1.652 |
| | B | 18 | 4.600 | 0.170 | 0.2942 | 15.64 | 1.415 |
| | C | 30 | 4.500 | 0.190 | 0.3089 | 13.42 | 1.515 |
| | D | 42 | 4.400 | 0.170 | 0.2837 | 14.32 | 1.295 |
| | E | 66 | 4.200 | 0.147 | 0.2505 | 15.07 | 1.020 |
| | F | 126 | 4.000 | 0.140 | 0.2339 | 14.36 | 0.881 |
| | G | 12 | 3.900 | 0.135 | 0.2242 | 14.15 | 0.808 |
| | H | 12 | 2.600 | 0.130 | 0.1696 | 6.57 | 0.346 |
| Compa. Example 2 | A | 40 | 4.650 | 0.146 | 0.2730 | 18.59 | 1.241 |
| | B | 70 | 4.550 | 0.146 | 0.2626 | 17.80 | 1.189 |
| | C | 40 | 4.450 | 0.146 | 0.2623 | 17.03 | 1.137 |
| | D | 110 | 4.300 | 0.146 | 0.2545 | 15.90 | 1.062 |
| | E | 20 | 4.150 | 0.146 | 0.2471 | 14.82 | 0.989 |
| | F | 40 | 3.900 | 0.146 | 0.2352 | 13.10 | 0.874 |
| | G | 12 | 2.850 | 0.146 | 0.1936 | 7.03 | 0.467 |
| Compa. Example 3 | A | 60 | 3.810 | 0.160 | 0.245 | 17.87/4.04 | 1.086 |
| | B | 70 | 3.810 | 0.154 | 0.239 | 18.33/4.26 | 1.041 |
| | C | 50 | 3.510 | 0.160 | 0.232 | 16.01/3.25 | 0.936 |
| | D | 60 | 3.210 | 0.160 | 0.220 | 14.10/2.60 | 0.793 |
| | E | 80 | 3.010 | 0.160 | 0.213 | 12.82/2.23 | 0.703 |
| | F | 100 | 3.010 | 0.154 | 0.207 | 13.20/2.33 | 0.675 |
| Compa. Example 4 | A | 66 | 4.400 | 0.155 | 0.2687 | 15.69 | 1.180 |
| | B | 24 | 4.250 | 0.155 | 0.2610 | 14.64 | 1.101 |
| | C | 60 | 4.150 | 0.155 | 0.2561 | 13.97 | 1.050 |
| | D | 150 | 3.950 | 0.155 | 0.2465 | 12.66 | 0.952 |
| | E | 24 | 3.800 | 0.155 | 0.2397 | 11.72 | 0.881 |
| | F | 30 | 3.650 | 0.155 | 0.2331 | 10.82 | 0.813 |

TABLE 3

Figure 13:
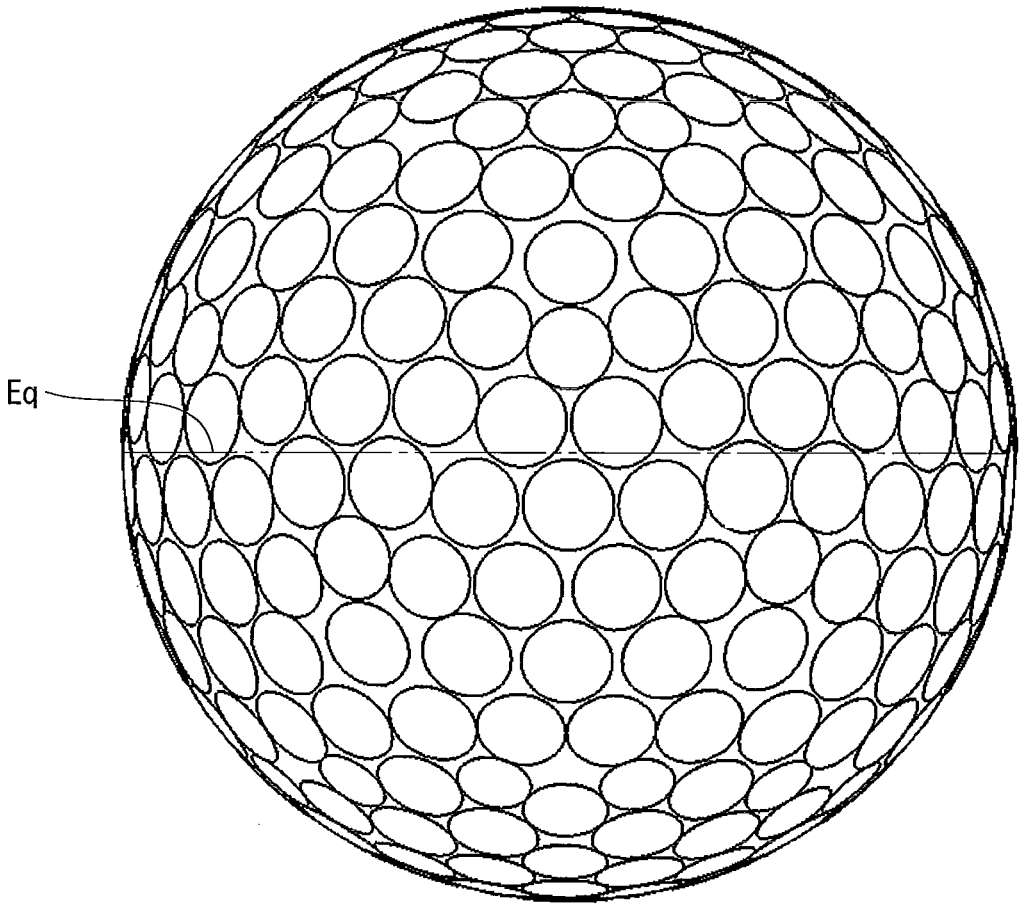
FIG. 13 is a front view of a golf ball according to Example 1 of the present invention.
Figure 14:
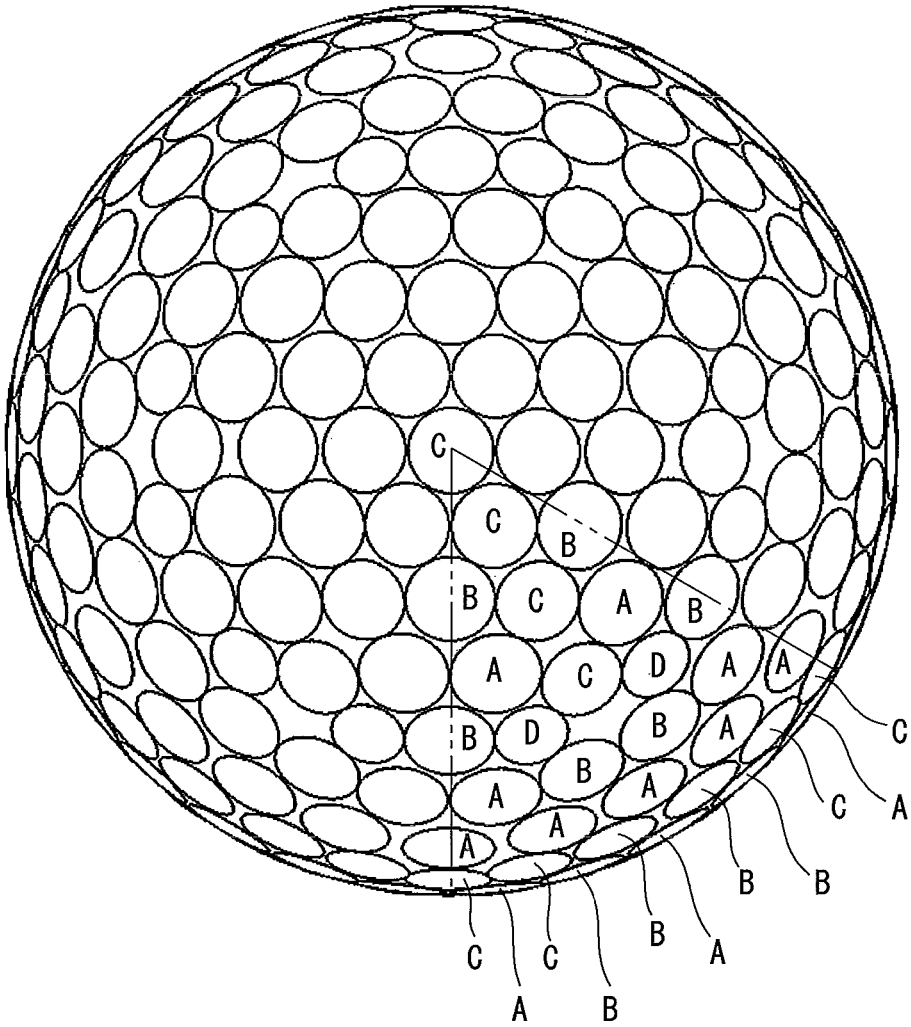
FIG. 14 is a plan view of the golf ball in FIG. 13.
Figure 15:
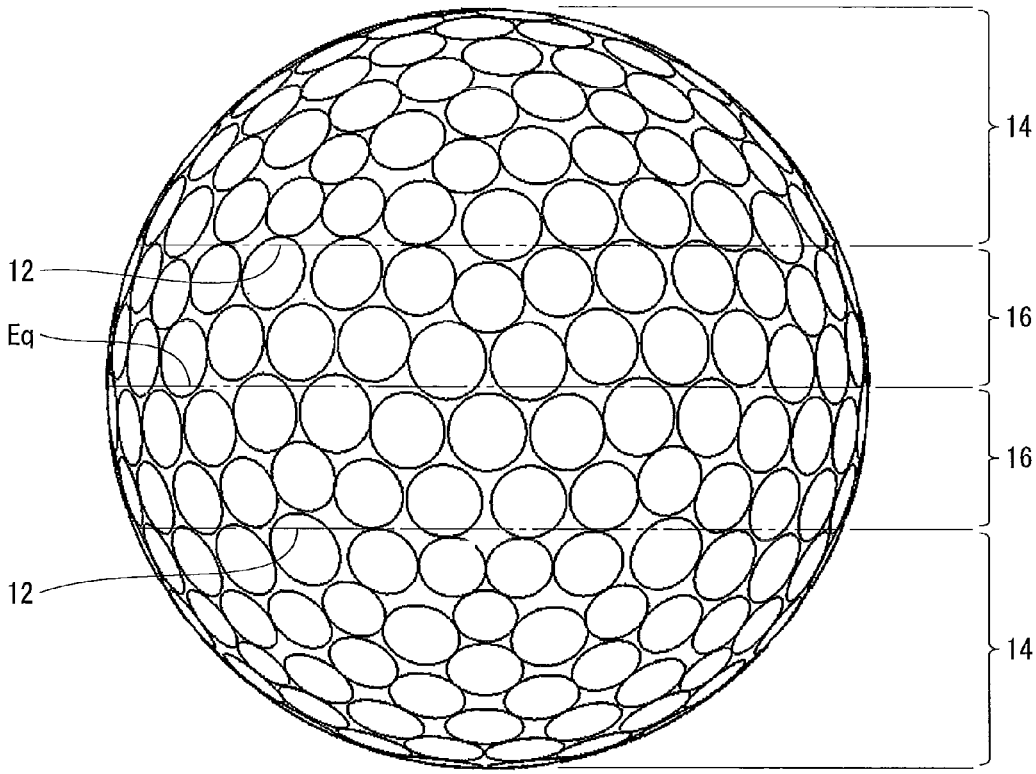
FIG. 15 is a front view of a golf ball according to Example 2 of the present invention.
Figure 16:
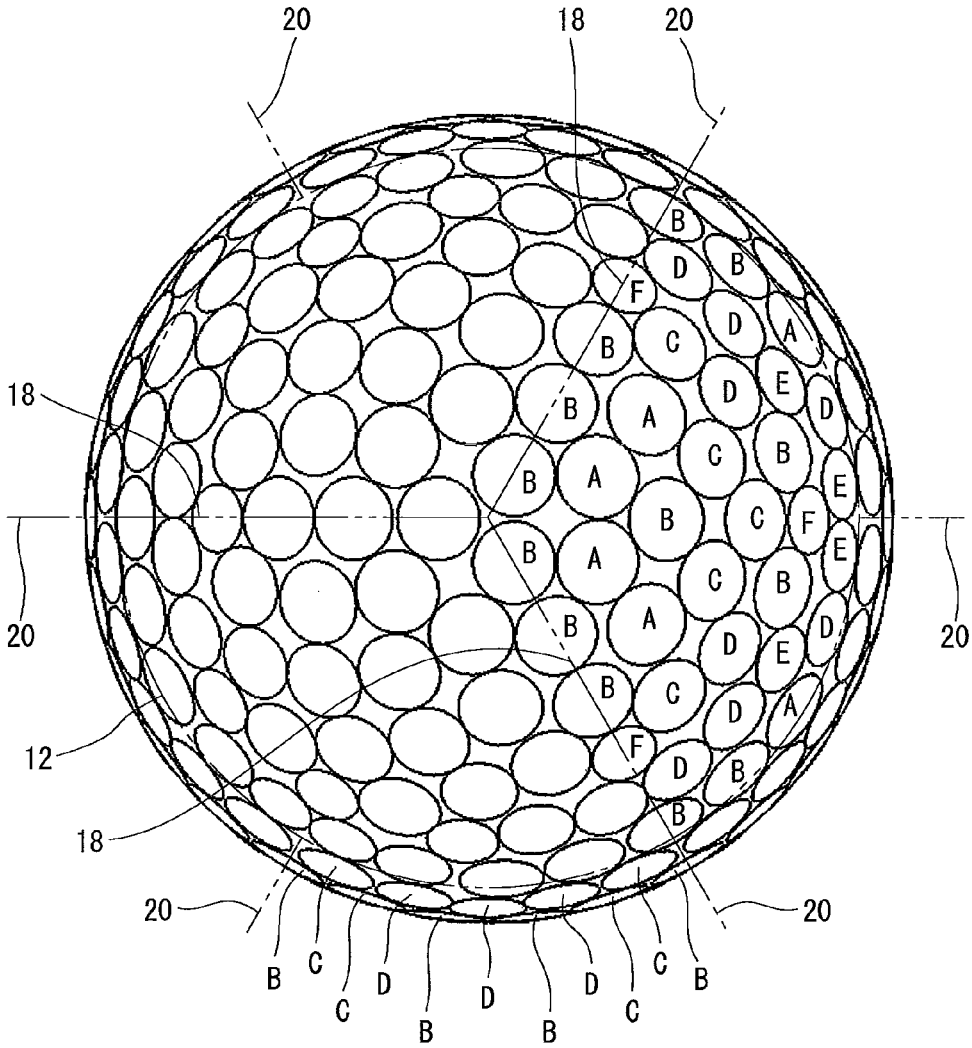
FIG. 16 is a plan view of the golf ball in FIG. 15.
Figure 17:
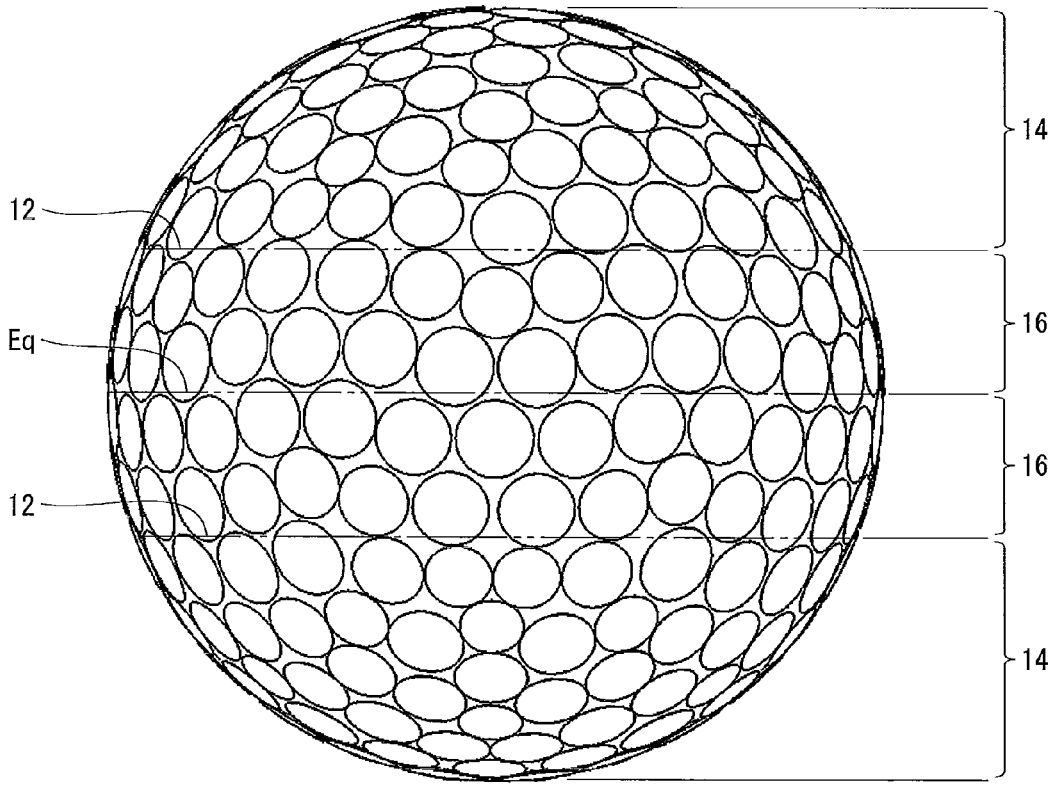
FIG. 17 is a front view of a golf ball according to Example 4 of the present invention.
Figure 18:
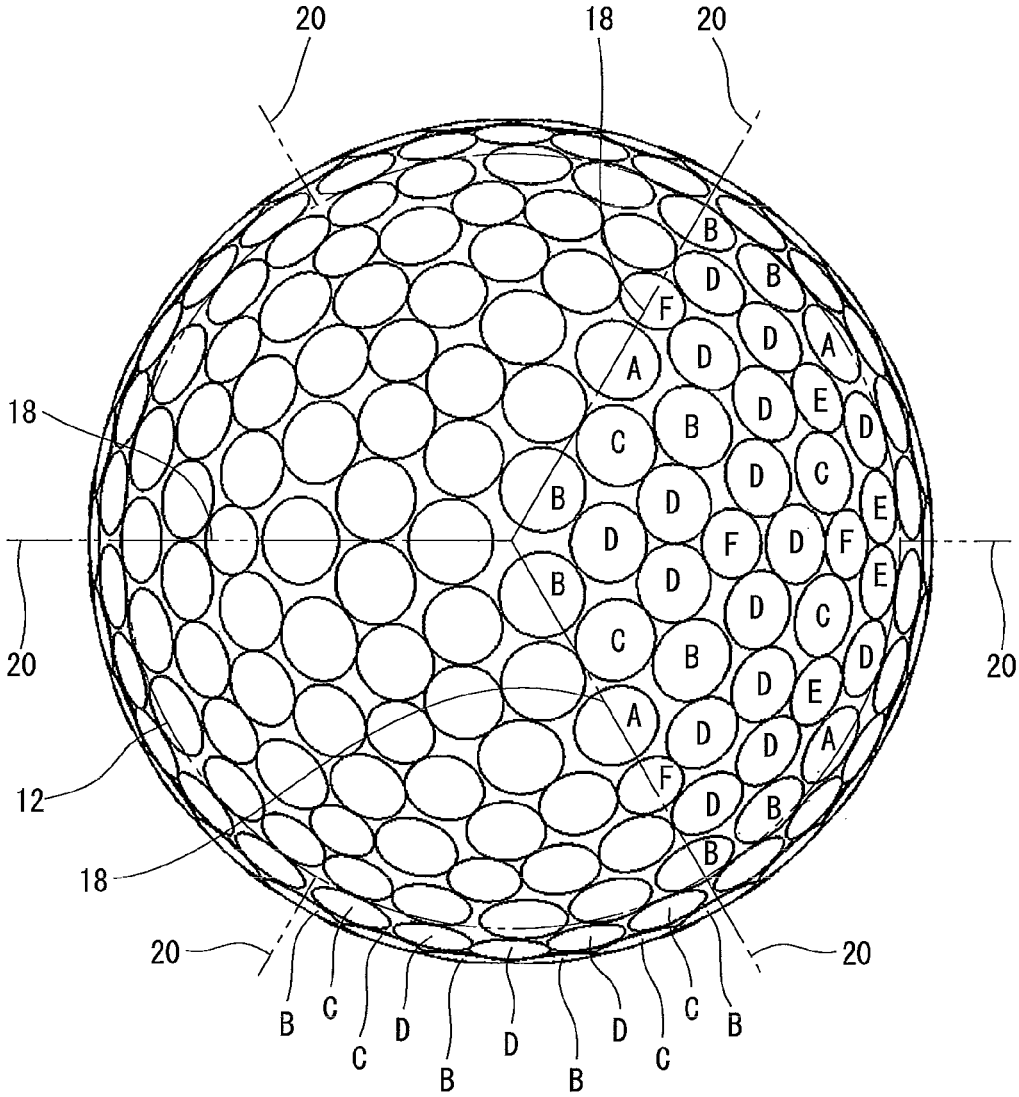
FIG. 18 is a plan view of the golf ball in FIG. 17.
Figure 19:
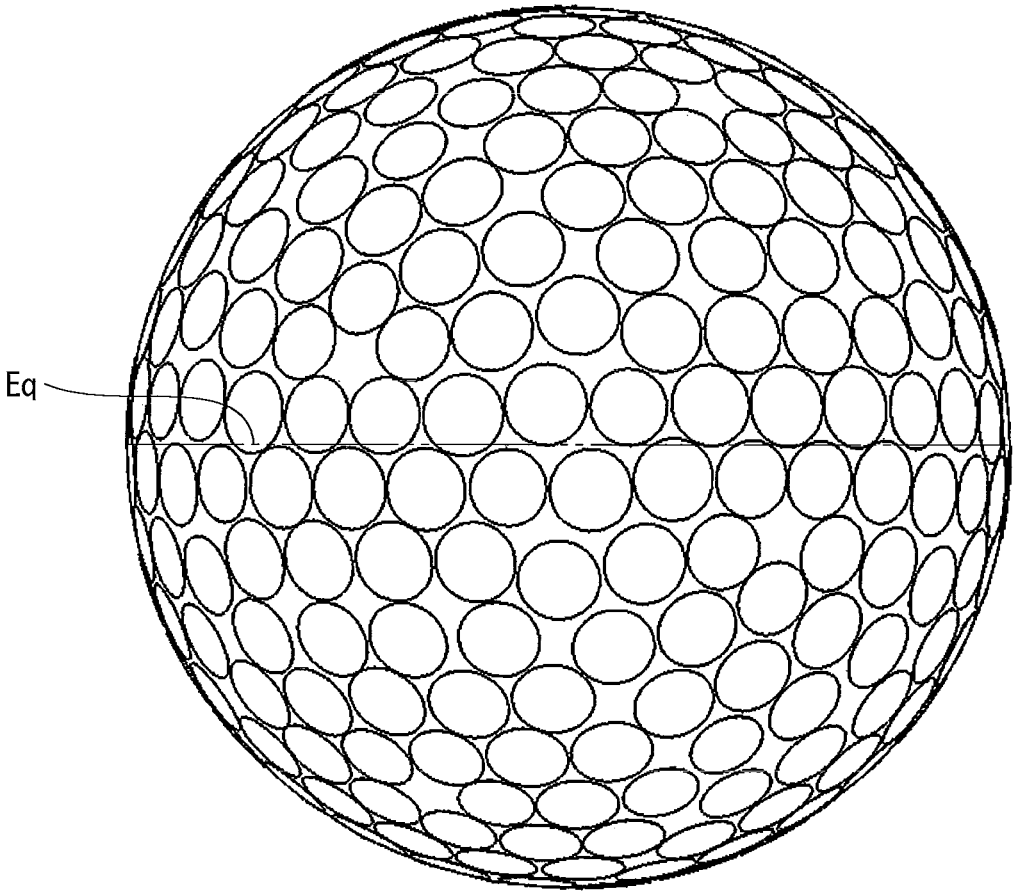
FIG. 19 is a front view of a golf ball according to Example 5 of the present invention.
Figure 20:
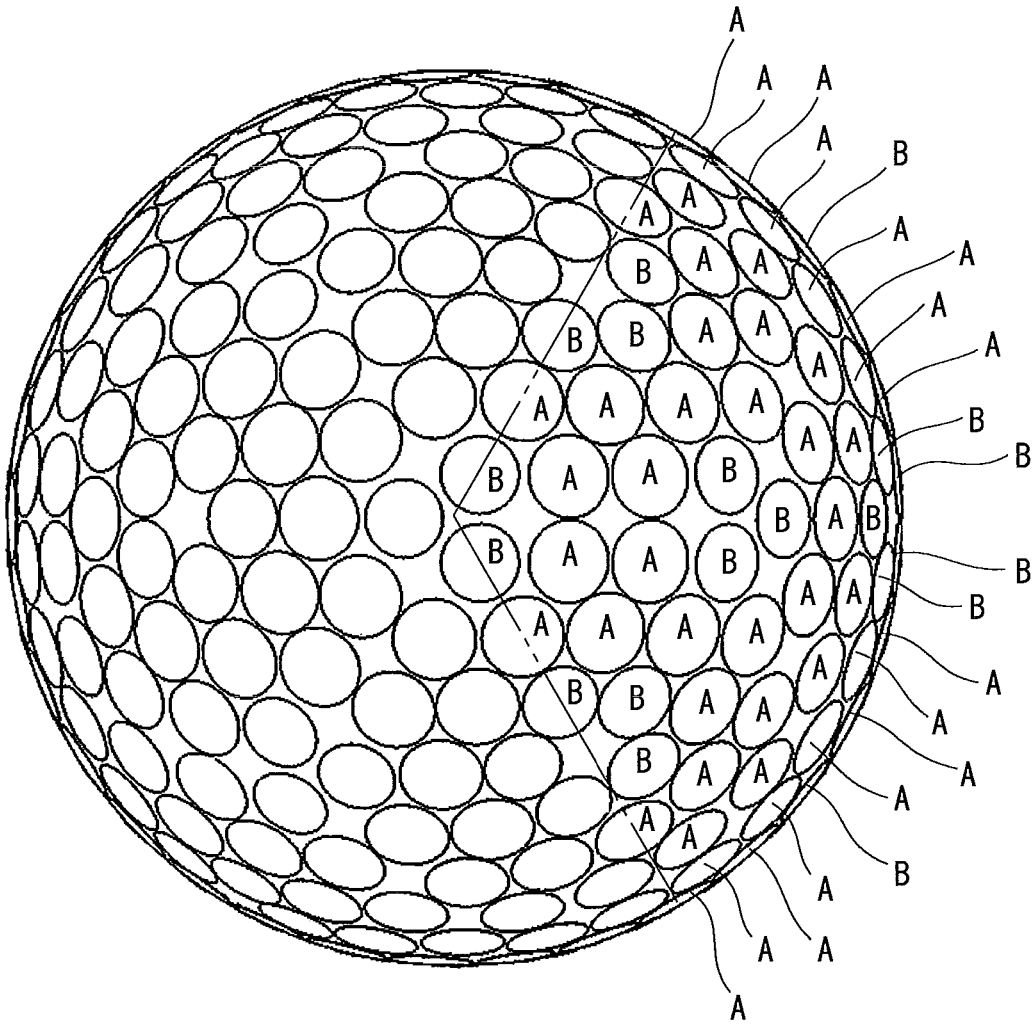
FIG. 20 is a plan view of the golf ball in FIG. 19.

| Results of Evaluation | | | | | |
|---|---|---|---|---|---|
| | Example 1 | Example 2 | Example 3 | Example 4 | Example 5 |
| Front view | FIG. 13 | FIG. 15 | FIG. 2 | FIG. 17 | FIG. 19 |
| Plan view | FIG. 14 | FIG. 16 | FIG. 3 | FIG. 18 | FIG. 20 |
| Peak value Ps (mm) | 401 | 278 | 405 | 276 | 270 |
| Peak value Pp (mm) | 397 | 439 | 566 | 549 | 366 |

TABLE 3-continued

| Results of Evaluation | | | | | |
|---|---|---|---|---|---|
| | Example 1 | Example 2 | Example 3 | Example 4 | Example 5 |
| Order Fs | 25 | 28 | 25 | 28 | 25 |
| Order Fp | 35 | 33 | 33 | 33 | 37 |
| Ps + Pp (mm) | 798 | 716 | 971 | 825 | 637 |

TABLE 3-continued

| Results of Evaluation | | | | | |
|---|---|---|---|---|---|
| | Example 1 | Example 2 | Example 3 | Example 4 | Example 5 |
| Absolute value of Ps − PP (mm) | 4 | 161 | 162 | 274 | 96 |
| Absolute value of Fs − Fp | 10 | 5 | 8 | 5 | 12 |
| Number of units Ne | 6 | 6 | 6 | 6 | 3 |
| Number of units Np | | 3 | 3 | 3 | |
| Occupation ratio (%) | 81 | 80 | 81 | 81 | 76 |
| Σ | 0.22 | 0.22 | 0.23 | 0.22 | 0.11 |
| Flight distance (m) | 243.2 | 242.4 | 241.7 | 240.8 | 240.4 |

TABLE 4

| Results of Evaluation | | | | |
|---|---|---|---|---|
| | Compa. Example 1 | Compa. Example 2 | Compa. Example 3 | Compa. Example 4 |
| Front view | FIG. 21 | FIG. 23 | FIG. 25 | FIG. 27 |
| Plan view | FIG. 22 | FIG. 24 | FIG. 26 | FIG. 28 |
| Peak value Ps (mm) | 151 | 186 | 352 | 123 |
| Peak value Pp (mm) | 444 | 317 | 278 | 317 |
| Order Fs | 55 | 27 | 41 | 25 |
| Order Fp | 33 | 31 | 39 | 35 |
| Ps + Pp (mm) | 595 | 503 | 630 | 440 |
| Absolute value of Ps − PP (mm) | 293 | 131 | 73 | 194 |
| Absolute value of Fs − Fp | 22 | 4 | 2 | 10 |
| Number of units | 3 | 5 | 5 | 3 |
| Occupation ratio (%) | 79 | 85 | 65 | 80 |
| Σ | 0.38 | 0.36 | 0.35 | 0.22 |
| Flight distance (m) | 239.3 | 238.6 | 238.0 | 237.1 |

As shown in Tables 3 and 4, the golf balls of Examples have excellent flight performance. From the results of evaluation, advantages of the present invention are clear.

The above dimple pattern is applicable to a one-piece golf ball, a multi-piece golf ball, and a thread-wound golf ball, in addition to a two-piece golf ball. The above description is merely for illustrative examples, and various modifications can be made without departing from the principles of the present invention.

What is claimed is:

1. A golf ball having a large number of dimples on a surface thereof, wherein a ratio of a sum of areas of these dimples to a surface area of a phantom sphere of the golf ball is equal to or greater than 70%, and a sum (Ps+Pp) of a peak value Ps and a peak value Pp is equal to or greater than 600 mm, the peak value Ps and the peak value Pp being obtained by the steps of:

(1) assuming a line connecting both poles of the golf ball as a first rotation axis;

(2) assuming a great circle which exists on a surface of the phantom sphere of the golf ball and is orthogonal to the first rotation axis;

(3) assuming two small circles which exist on the surface of the phantom sphere of the golf ball, which are orthogonal to the first rotation axis, and of which an absolute value of a central angle with the great circle is 30°;

(4) defining a region, of the surface of the golf ball, which is obtained by dividing the surface of the golf ball at the two small circles and which is sandwiched between the two small circles;

(5) determining 30240 points, on the region, which are arranged at intervals of a central angle of 3° in a direction of the first rotation axis and at intervals of a central angle of 0.25° in a direction of rotation about the first rotation axis;

(6) calculating a length L1 of a perpendicular line which extends from each point to the first rotation axis;

(7) calculating a total length L2 by summing 21 lengths L1 which are calculated on the basis of 21 perpendicular lines arranged in the direction of the first rotation axis;

(8) obtaining a first transformed data constellation by performing Fourier transformation on a first data constellation of 1440 total lengths L2 which are calculated along the direction of rotation about the first rotation axis;

(9) determining the peak value Ps and an order Fs of a maximum peak of the first transformed data constellation;

(10) assuming a second rotation axis orthogonal to the first rotation axis assumed at the step (1);

(11) assuming a great circle which exists on the surface of the phantom sphere of the golf ball and is orthogonal to the second rotation axis;

(12) assuming two small circles which exist on the surface of the phantom sphere of the golf ball, which are orthogonal to the second rotation axis, and of which an absolute value of a central angle with the great circle is 30°;

(13) defining a region, of the surface of the golf ball, which is obtained by dividing the surface of the golf ball at the two small circles and which is sandwiched between the two small circles;

(14) determining 30240 points, on the region, which are arranged at intervals of a central angle of 3° in a direction of the second rotation axis and at intervals of a central angle of 0.25° in a direction of rotation about the second rotation axis;

(15) calculating a length L1 of a perpendicular line which extends from each point to the second rotation axis;

(16) calculating a total length L2 by summing 21 lengths L1 which are calculated on the basis of 21 perpendicular lines arranged in the direction of the second rotation axis;

(17) obtaining a second transformed data constellation by performing Fourier transformation on a second data constellation of 1440 total lengths L2 which are calculated along the direction of rotation about the second rotation axis; and

(18) determining the peak value Pp and an order Fp of a maximum peak of the second transformed data constellation.

2. The golf ball according to claim 1, wherein the sum (Ps+Pp) is equal to or less than 1000 mm.

3. The golf ball according to claim 1, wherein an absolute value of a difference (Ps−Pp) between the peak value Ps and the peak value Pp is equal to or less than 250 mm.

4. The golf ball according to claim 1, wherein each of the order Fs and the order Fp, which are obtained by the steps (1) to (18), is equal to or greater than 20 and equal to or less than 40, and an absolute value of a difference (Fs−Fp) between the order Fs and the order Fp is equal to or less than 10.

5. The golf ball according to claim 1, wherein each of a northern hemisphere and a southern hemisphere of the surface of the golf ball has a pole vicinity region and an equator vicinity region, a dimple pattern of the pole vicinity region includes a plurality of units that are rotationally symmetrical to each other about the pole, a dimple pattern of the equator vicinity region includes a plurality of units that are rotationally symmetrical to each other about the pole, and the number Np of the units of the pole vicinity region is different from the number Ne of the units of the equator vicinity region.

6. The golf ball according to claim 5, wherein the number Np is equal to or greater than 3 and equal to or less than 6.

7. The golf ball according to claim 5, wherein the number Ne is equal to or greater than 3 and equal to or less than 6.

8. The golf ball according to claim 5, wherein one of the number Np and the number Ne is a multiple of the other of the number Np and the number Ne.

9. The golf ball according to claim 5, wherein a latitude of a boundary line located between the pole vicinity region and the equator vicinity region is equal to or greater than 20° and equal to or less than 40°.

10. The golf ball according to claim 5, wherein a ratio of the number of the dimples that exist in the pole vicinity region to the number of the dimples that exist in the hemisphere is equal to or greater than 20% and equal to or less than 70%.

11. The golf ball according to claim 5, wherein a ratio of the number of the dimples that exist in the equator vicinity region to the number of the dimples that exist in the hemisphere is equal to or greater than 20% and equal to or less than 70%.

12. The golf ball according to claim 5, wherein each dimple has a depth of 0.05 mm or greater and 0.60 mm or less, an average depth of the dimples in the equator vicinity region is greater than an average depth of the dimples in the pole vicinity region, and a difference between the average depth of the dimples in the equator vicinity region and the average depth of the dimples in the pole vicinity region is equal to or greater than 0.004 mm and equal to or less than 0.020 mm.

13. The golf ball according to claim 1, wherein a standard deviation of diameters of all the dimples is equal to or less than 0.30.

* * * * *